US009745728B2

(12) United States Patent
Beck et al.

(10) Patent No.: US 9,745,728 B2
(45) Date of Patent: Aug. 29, 2017

(54) POP-UP DRAIN ASSEMBLY

(75) Inventors: Harold Kent Beck, Copper Canyon, TX (US); Sanjay Ahuja, Katy, TX (US)

(73) Assignee: PF Waterworks LP, Houston, TX (US)

( * ) Notice: Subject to any disclaimer, the term of this patent is extended or adjusted under 35 U.S.C. 154(b) by 1301 days.

(21) Appl. No.: 13/018,389

(22) Filed: Jan. 31, 2011

(65) Prior Publication Data

US 2011/0185494 A1 Aug. 4, 2011

Related U.S. Application Data

(60) Provisional application No. 61/337,100, filed on Feb. 1, 2010, provisional application No. 61/304,575, filed on Feb. 15, 2010, provisional application No. 61/307,881, filed on Feb. 25, 2010.

(51) Int. Cl.
*E03C 1/23* (2006.01)

(52) U.S. Cl.
CPC ..... *E03C 1/23* (2013.01); *E03C 1/2302* (2013.01); *E03C 2001/2311* (2013.01)

(58) Field of Classification Search
USPC ..... 4/689, 690, 691, 692
See application file for complete search history.

(56) References Cited

U.S. PATENT DOCUMENTS 773,408 A 10/1904 Moore
1,647,188 A 11/1927 Mueller et al.
1,823,038 A 8/1929 Hoelscher
1,925,767 A 9/1933 Mallory
1,980,250 A 11/1934 Baxter
2,179,121 A * 11/1939 Frank et al. ..... E03C 1/2304 4/689
2,281,448 A 4/1942 Mathey
2,486,246 A * 10/1949 Beeke ..... E03C 1/23 251/235
2,807,806 A 10/1957 Watkins
2,827,639 A * 3/1958 Schmidt ..... E03C 1/23 285/204
3,002,196 A * 10/1961 Mackey, Jr. ..... 4/689
(Continued)

FOREIGN PATENT DOCUMENTS

DE 2842490 A 9/1978
JP 2009068264 A 4/2009

OTHER PUBLICATIONS

PCT International Search Report and Written Opinion mailed Apr. 1, 2011, for corresponding International Application No. PCT/US2011/023257.

*Primary Examiner* — Lauren Crane
(74) *Attorney, Agent, or Firm* — Stephen S. Hodgson

(57) ABSTRACT

A pop-up drain assembly for a sink has drain piping, a stopper in the drain piping, a pivot rod for opening and closing the stopper and tends not to clog because the pivot rod is not within a fluid flow path. In one embodiment the stopper has flow diverter plates that channel fluid flowing through the drain piping away from the pivot rod so that hair, waste and debris does not catch on and accumulate on the pivot rod. In another embodiment the stopper and the pivot rod are engaged through magnetic coupling, and the pivot rod does not protrude into the fluid flow path. The stopper is preferably variable in length for adjustment to fit different distances from the pivot rod to the top of the drain piping.

35 Claims, 9 Drawing Sheets

(56) References Cited

U.S. PATENT DOCUMENTS

| | | | | |
|---|---|---|---|---|
| 3,102,277 | A | 9/1963 | Anderson | |
| 4,192,026 | A | 3/1980 | Williams | |
| 4,577,349 | A | 3/1986 | Clegg | |
| 4,596,057 | A | 6/1986 | Ohta et al. | |
| 4,807,306 | A | 2/1989 | Hayman et al. | |
| 4,903,943 | A * | 2/1990 | Hochstrasser | E03C 1/23 251/229 |
| 5,208,921 | A * | 5/1993 | Nicoll | 4/286 |
| 5,363,519 | A | 11/1994 | Husting | |
| 5,640,724 | A * | 6/1997 | Holmes | A47K 1/14 4/295 |
| 5,749,561 | A | 5/1998 | Worthington | |
| 5,787,521 | A | 8/1998 | O'Connell et al. | |
| 5,822,812 | A * | 10/1998 | Worthington et al. | 4/689 |
| 6,088,842 | A | 7/2000 | Barnett | |
| 6,219,861 | B1 | 4/2001 | Chen | |
| 6,282,730 | B1 | 9/2001 | Duncan | |
| 6,308,351 | B1 | 10/2001 | Franke | |
| 6,367,102 | B1 * | 4/2002 | McMullen | E03C 1/2302 4/286 |
| 6,470,514 | B2 | 10/2002 | Onoue | |
| 6,484,330 | B2 | 11/2002 | Gray et al. | |
| 6,973,685 | B2 | 12/2005 | Duncan | |
| 2003/0041374 | A1 | 3/2003 | Franke | |
| 2006/0179564 | A1 | 8/2006 | Jacobs | |
| 2009/0151060 | A1 * | 6/2009 | Zubillaga et al. | 4/292 |
| 2009/0255041 | A1 * | 10/2009 | Duncan | 4/295 |
| 2010/0154114 | A1 | 6/2010 | Van Zeeland et al. | |

* cited by examiner 80
80f
80b
80k
80j
82a
82
82b
80h
80i
80g
80k
80a 80
80f
78
80b
80j
80k
80d
80e
80j
80b''
80b'
80h
78a
80i
80a
82a
82
82b
80c
80a'
80a''
80g 80b
82b
82
80h
80i
80k
80j
82a
80g
80a
80i 76
76e
76b
76c
76g'
76g
76i
76h
76d
76a
76i
76f'
76f 150
152
154
158
102
106
104a
104
108
110
166
122a
120
122
124
118
116
164
164a
102a
156
104b
154a
162
112
112a
112b 100
132
134
130a
130c
102
106
104a
104
108
110
140
122a
120
126
122
124
118
116
138
138a
102a
130b
104b
130
136
112
112a
112b

POP-UP DRAIN ASSEMBLY

CROSS REFERENCE TO RELATED APPLICATIONS

This application claims priority to and the benefit of U.S. Provisional Patent Application Ser. No. 61/337,100, filed Feb. 1, 2010, U.S. Provisional Patent Application Ser. No. 61/304,575, filed Feb. 15, 2010, and U.S. Provisional Patent Application Ser. No. 61/307,881, filed Feb. 25, 2010, each of which is incorporated by reference.

BACKGROUND OF THE INVENTION

1. Field of the Invention

This present invention pertains to a pop-up drain assembly used to retain fluid in and release fluid from a sink or basin and more particularly to preventing debris such as hair from being caught in a drain pipe either by directing flow away from a pivot rod or by eliminating the pivot rod from within the drain pipe.

2. Description of the Related Art

In a lavatory or bathroom sink or basin equipped with a supply of running water for washing oneself, a pop-up drain assembly allows one to retain water in the sink or basin and then release the water to flow by gravity downwardly through a drain pipe. The sink or basin has an opening at a lowermost point, and a typical pop-up drain assembly comprises a drain conduit sealingly fastened to the sink or basin within the opening. A drain stopper is received in the drain conduit for sealing the opening and retaining water in the sink or basin. A pivot rod protrudes into the drain conduit and engages a bottom portion of the drain stopper. A lift rod is connected to the pivot rod. One can pull the lift rod up to pull the drain stopper down for sealing the opening in the bottom of the sink or basin for retaining water, and one can push the lift rod down to raise the drain stopper, which unseals the drain stopper and allows water to drain from the sink or basin. U.S. Pat. No. 4,807,306, issued to Hayman et al., illustrates quite well the components in a typical prior art pop-up drain assembly and is incorporated by reference for all purposes.

As water drains from the sink, the water flows around and along the drain stopper and over the portion of the pivot rod that protrudes into the drain conduit. Debris and/or waste in the water, such as soap, dirt, oils, toothpaste and particularly hair, catches on and clings to an end of the pivot rod, where the pivot rod protrudes into the drain conduit and engages with the bottom portion of the drain stopper. Accumulation of such debris and waste on the pivot rod and drain stopper clogs the drain conduit and causes water to not drain properly. To restore proper drainage through the drain conduit, one needs to remove and clean the pivot rod and the drain stopper. Removal of the pivot rod and drain stopper requires disassembly of a sealed connection of the pivot rod to the drain conduit, which is a messy and time-consuming task, and if a plumber is hired to provide the service, then it is also an expensive task. Improvements are needed in a pop-up drain assembly for reducing the accumulation of waste and debris in the drain assembly, and consequently, for reducing clogging in the drain assembly that slows or stops drainage through the drain conduit.

SUMMARY OF THE INVENTION

In one embodiment, the present invention provides a pop-up drain assembly for a sink or basin having a drain opening, which includes: drain piping, typically a drain flange and a drain body, which provides a fluid flow pathway from the sink or basin through the drain opening and through the piping; a stopper for retaining fluid in the sink or basin, which is received in the piping and which is moveable between an open position and a closed position; and a pivot rod for moving the stopper between the open position and the closed position, where the pivot rod is not in the fluid flow pathway. In one embodiment, fluid, typically water, draining through the drain piping is diverted around a pivot rod that extends into or protrudes inside the piping, which prevents hair, waste and debris from catching on the pivot rod. In another embodiment, the pivot rod does not protrude or extend into the piping significantly, and the pivot rod moves the stopper up and down through magnetic coupling between the stopper and the pivot rod, which also prevents hair, waste and debris from catching on the pivot rod.

In the embodiment where the pivot rod protrudes inside the drain piping, the pivot rod physically engages the stopper for moving the stopper up and down. In this embodiment, the stopper has a plug-type body with a central, longitudinal shaft. A pair of opposing, longitudinal plates are attached at an upper end of the plates to the body of the stopper. The plates extend downwardly about the pivot rod such that the pivot rod is between the plates, and the plates extend about to or below the pivot rod. The plates are sized and designed with respect to the diameter of the drain piping so that fluid draining through the drain piping is diverted around the pivot rod, flowing along an outside surface of each plate while the pivot rod is on the inside of the plates. Hair, waste and debris flows on through the drain piping with the fluid and does not tend to get caught on or accumulate on the pivot rod or on the lower portion of the stopper that is engaged with the pivot rod. The stopper is preferably removeable from and attachable to the pivot rod, without needing to remove the pivot rod from the drain piping. The stopper is also preferably designed to provide more than one distance between the point where the pivot rod engages the stopper and a cap on an upper end of the stopper, which allows the stopper to fit drain assemblies made by different manufacturers.

In the embodiment in which magnetic coupling between the stopper and the pivot rod is used so that the pivot rod can move the stopper up and down, where the pivot rod terminates about flush with the inside wall of the drain piping, either a plug type or a tubular type stopper body can be used. A permanent magnet or magnetic material is fixed on the stopper body such that the magnet or magnetic material is adjacent to a pivot rod port in the drain piping. A distal end of a pivot rod terminates approximately flush with the inside wall of the drain piping in the pivot rod port adjacent to the magnet or magnetic material on the stopper body. The distal end of the pivot rod is made of magnetic material or a magnet that is opposite of the magnet or magnetic material on the stopper so that there is a magnetic attraction between the distal end of the pivot rod and the stopper for providing a magnetic coupling.

In another embodiment, a stopper is provided, and in one variation, the stopper preferably includes flow diverter plates for directing fluid flow away from a pivot rod holder. One preferred stopper has a pivot rod holder that has a notch, which allows the stopper to be installed and removed from a drain assembly that has a pivot rod protruding into the drain assembly, without needing to remove the pivot rod from the drain assembly, and the pivot rod holder can preferably receive the pivot rod in more than one vertically-spaced location for providing height adjustment. One preferred embodiment of a stopper provides a magnet or magnetic material on the stopper for engagement with a pivot rod. The stopper is preferably adapted to accommodate drain assemblies from different manufacturers that have a different distance between the pivot rod and the top of the drain piping, which can be accomplished by using multiple magnets or sources of magnetic material spaced apart longitudinally and by a single longer, linear magnet or magnetic material. Another approach for adapting the stopper for different lengths is to alter the length of the stopper, such as through a connection of one portion of the stopper with another portion of the stopper, where the connection may be a threaded connection, or a friction-fit connection, a detent connection or a similar means of connection. This approach can be used with either the flow diverter guard plates or with the magnetically-coupled stopper. It is also preferable to be able to adjust the length of the pivot rod between the pivot ball and the distal end of the pivot rod that engages the stopper, such as by being able to move the pivot ball with respect to the pivot rod through a detent connection, a friction fit or by a threaded connection and/or by moving the distal end adjacent to the stopper by providing a tip that is biased outwardly by a spring or resilient material. In another embodiment, a stopper is fitted with screening means for trapping objects and debris, where the stopper is preferably removeable from and attachable to the pivot rod without removing the pivot rod, or the stopper is magnetically coupled to the pivot rod, so that the stopper can be removed, cleaned and replaced.

BRIEF DESCRIPTION OF THE DRAWINGS

A better understanding of the invention can be obtained when the detailed description of exemplary embodiments set forth below is considered in conjunction with the attached drawings in which.

DETAILED DESCRIPTION OF THE EXEMPLARY EMBODIMENTS

The present invention provides a pop-up drain assembly for a sink or basin for receiving and retaining a fluid, which is typically water, and a drain opening is provided in a lowermost portion of the sink or basin for draining the fluid. The pop-up drain assembly includes piping that can be placed through the drain opening and fastened to the sink or basin. The piping is typically connected to a drain pipe, and the piping provides a fluid flow pathway from the sink or basin through the drain opening and through the piping to the drain pipe for conveying fluid from the sink or basin to the drain pipe and away for disposal and/or treatment. After the drain assembly is installed on a sink, a drain stopper is received in the piping and is moveable between an open position and a closed position. In the closed position, the stopper provides a seal with the piping for retaining fluid in the sink or basin, and in the open position, fluid can enter the piping and drain away through the drain pipe. A pivot rod is used to move the stopper between the open position and the closed position. The pivot rod pivots about a generally horizontal position and engages the stopper, raising the stopper to the open position and lowering the stopper to the closed position.

In the drain assembly of the present invention, the pivot rod is not in the fluid flow pathway while in operation. The pivot rod either protrudes inside the piping for moving the stopper and fluid flow is diverted around the pivot rod for preventing hair and other debris from catching on the pivot rod or the pivot rod does not protrude significantly inside the piping and is magnetically coupled to the stopper for moving the stopper. In a prior art pop-up drain assembly, the pivot rod was typically in the fluid flow pathway, and hair and debris caught on the pivot rod and stopper, which clogged the drain assembly. The present invention provides a pop-up drain assembly in which the pivot rod is not in the fluid flow pathway, so clogging in the drain assembly should be reduced.

Figure 1:
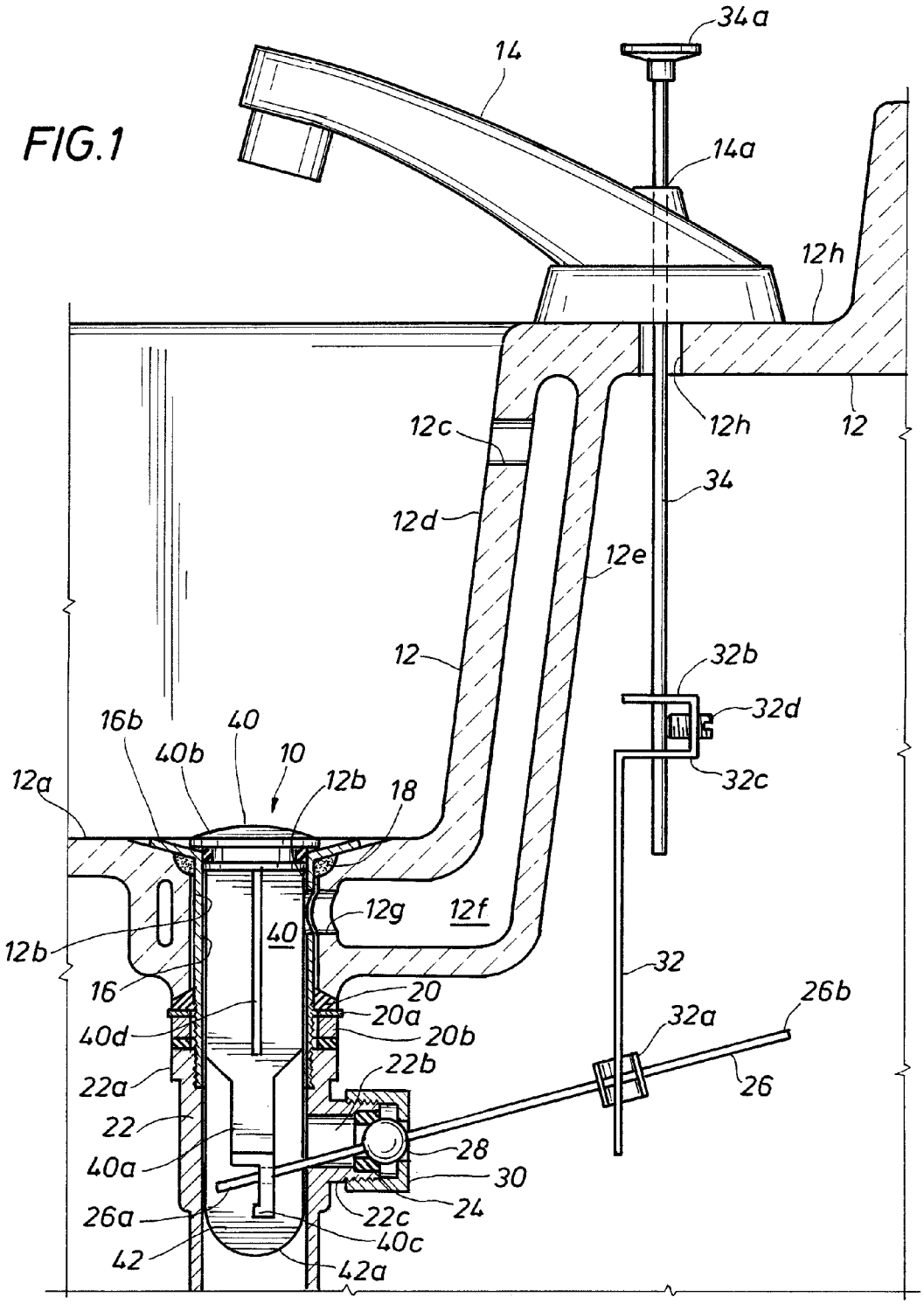
FIG. 1 is a cross-section of a side elevation of a sink or basin and a pop-up drain assembly, according to the present invention.

Turning now to the drawings and with reference to FIG. 1, a pop-up drain assembly 10 is shown according to the present invention. Drain assembly 10 is received in a sink or basin 12, such as is typically used in a lavatory. Sink 12 has a lower surface 12*a* that drains into a drain opening 12*b*. Sink 12 has an overflow port 12*c* in a side wall 12*d*, which is an optional feature. An outer wall 12*e* and side wall 12*d* define an overflow channel 12*f*, and side wall 12*d* has an overflow drain port 12*g* for draining overflow fluid into a port in drain assembly 10. A faucet 14 is mounted on a top deck 12*h* of sink 12 for supplying water or other fluid to sink 12.

A number of different manufacturers make and sell pop-up drain assemblies, which can be retrofitted to provide a pop-up drain assembly according to the present invention. In the embodiment depicted in FIG. 1, pop-up drain assembly 10 comprises a drain flange 16 that fits down through drain opening 12*b* in sink 12. Preferably, drain flange 16 has a threaded tubular portion 16*a* extending essentially throughout its full length and a flange 16*b* extends radially outwardly on a top end. A gasket or plumber's putty 18 provides a seal between the lower surface 12*a* of the sink 12 and the flange 16*b* of drain flange 16. A flexible gasket 20 and a washer 20*a* are placed around a bottom portion of drain flange 16 and then pressed tightly against a bottom surface of sink 12 with a threaded nut 20*b*. A drain body 22 is threaded onto a lower end of drain flange 16. Drain body 22 has a wrench flange 22*a* for receiving a wrench for tightening and loosening drain body 22 with respect to drain flange 16. Drain body 22 has a pivot rod port 22*b*, and a threaded tubular stub 22*c* projects radially outwardly from drain body 22. A pivot rod seal 24 is received in stub 22*c*.

A pivot rod 26 has a stopper end 26*a* and an outer end 26*b*. A pivot ball 28 is sealingly received on pivot rod 26 closer to stopper end 26*a* than outer end 26*b*. Pivot rod 26 is received in stub 22*c* such that stopper end 26*a* is inside the drain body 22, and the stopper ball 28 rests against pivot rod seal 24. A pivot rod cap 30 is threaded onto stub 22*c* sufficiently tightly to seal pivot ball 28 against pivot rod seal 24, but loose enough to allow pivot ball 28 and pivot rod 26 to pivot. An extension rod 32 having a plurality of holes, which are not shown, is received on outer end 26*b* of pivot rod 26 and held in place by a clip 32*a*. Extension rod 32 is bent so as to have two parallel portions 32*b* and 32*c* that are perpendicular to the longitudinal axis of the extension rod 32, and each of the two parallel portions has a hole through which a control rod 34 is received. Control rod 34 passes through a faucet port 14*a* and a sink control rod port 12*h*. Control rod 34 has a knob 34*a* at an upper end, and control rod 34 is fastened to extension rod 32 by a set screw 32*d*. There are various ways to connect a control rod to a pivot rod, and there are alternative means for controlling the pivot rod and the stopper, including a cable such as described in U.S. Pat. No. 5,822,812, issued to Worthington et al, and U.S. Pat. No. 4,596,057, issued to Ohta et al., which are incorporated by reference, and electronic means, which may include a solenoid, an electronic actuator and/or a motor.

A stopper 40 is received in drain flange 16 and drain body 22. Stopper 40 has an elongate shaft 40*a* running its length, which has a longitudinal axis through the center of stopper 40. A cap 40*b* is located on an upper end while the drain assembly 10 is installed and operational, and a pivot rod receiving member 40*c* is located on an opposing lower end. The pivot rod receiving member 40*c* defines an opening through which stopper end 26*a* of pivot rod 26 protrudes for engaging and moving stopper 40, and pivot rod receiving member 40*c* may be referred to as open member 40*c*. Four flanges or fins, referred to collectively as fins 40*d*, extend longitudinally along shaft 40*a* and project radially, and fins 40*d* lie in two perpendicular and intersecting planes. The fins provide structural support for the shaft and center the stopper in the drain pipe. A suitable number of fins can be used, including 2, 3, 4, 5, 6, 7, 8, 9, or 10 fins. The cap may be a separate piece that is received on the shaft, or the cap may be formed integral with the shaft. In one embodiment, the cap and shaft are formed of an integral piece of plastic, and the cap is coated with a metal such as chrome, nickel or brass. The stopper may also be made of a combination of metal and plastic.

A debris-guard flow diverter 42 is attached at an upper end to shaft 40*a* and fins 40*d*. Debris-guard flow diverter 42 has a lower free end 42*a* that extends below end 26*a* of pivot rod 26, although free end 42*a* may terminate above end 26*a* of pivot rod 26. If water is in sink 12, one can drain the water by pushing down on knob 34*a* of control rod 34, which pivots stopper end 26*a* of pivot rod 26 upward about pivot ball 28, raising stopper cap 40*b*. With cap 40*b* raised into an open position, water flows into drain flange 16. Debris-guard flow diverter 42 directs the water to flow between the debris-guard flow diverter 42 and the inside wall of drain flange 16 and drain body 22. Consequently, water does not readily flow over stopper end 26*a* of pivot rod 26 or over open member 40*c* on the lower end of stopper 40, which results in less hair, soap, toothpaste and debris being caught on and accumulating on stopper end 26*a* of pivot rod 26 or on pivot rod receiving member 40*c*. Pop-up drain assembly 10 is less likely to become clogged, particularly by accumulation of hair on pivot rod 26, than conventional prior art drain assemblies. Debris-guard flow diverter 42 may be referred to as a hair guard because it is particularly useful for preventing strands of hair from being caught and retained on the pivot rod and the lower end of the stopper.

Figure 2A:
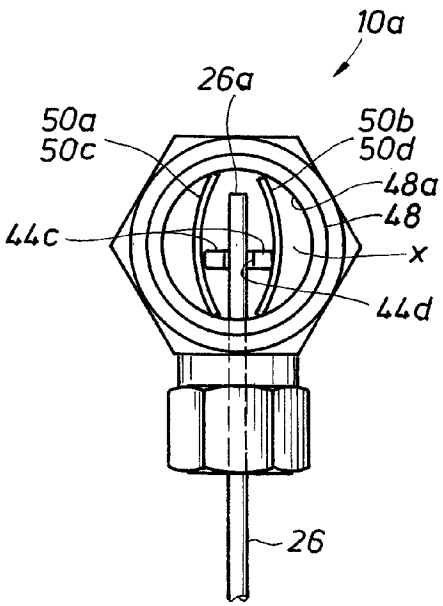
FIG. 2A is a plan view of the pop-up drain assembly of FIG. 2 as seen from the bottom, according to the present invention.
Figure 2:
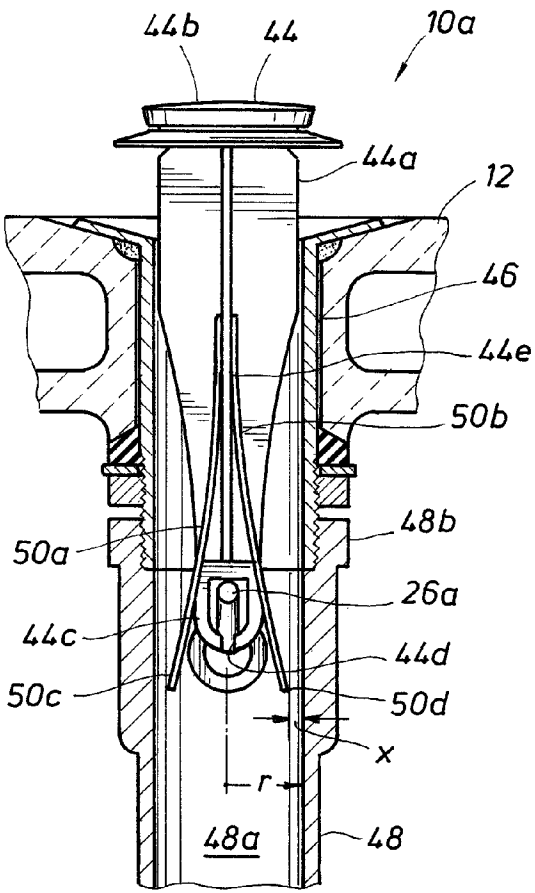
FIG. 2 is a cross-section of a side elevation of a pop-up drain assembly, according to the present invention.

Turning now to FIG. 2, a pop-up drain assembly 10*a* is shown in a cross-section of a side elevation, according to the present invention. FIG. 2A is a plan view of pop-up drain assembly 10*a* as seen from the bottom looking up. Drain assembly 10*a* is installed in sink 12 in the same manner as described with reference to FIG. 1. A stopper 44 is received in a drain flange 46. Drain flange 46 is connected to a drain body 48, which has an inside wall 48*a*, by a nut 48*b*. Stopper 44 has a body comprising longitudinal fins 44*a* that project radially outwardly at right angles to one another. A cap 44*b* is located on an upper end for sealing drain flange 46 and a notched open member 44*c* is located on a lower end of stopper 44. End 26*a* of pivot rod 26 is received in notched open member 44*c*, which has a notch or cut 44*d*. Notch or cut 44*d* allows stopper 44 to be pressed onto pivot rod 26 transversely, which allows stopper 44 to be installed and removed without the need to uninstall pivot rod 26 in order to engage pivot rod 26 with stopper 44. Debris-guard shields 50*a* and 50*b* are attached at an upper end to fins 44*a* of stopper 44 at a point 44*e*. Any suitable method can be used to connect debris-guard shields 50*a* and 50*b* to fins 44*a* of stopper 44, including integral plastic molding, gluing and spot welding.

Debris-guard shields 50*a* and 50*b* have a lower end 50*c* and 50*d*, respectively, that is free in that it is not secured to anything. Debris-guard shields 50*a* and 50*b* have a width that is nearly as great as the diameter of drain flange 46 and drain body 48. Debris-guard shields 50*a* and 50*b* are not completely rigid, but rather are somewhat stiff, but flexible. Debris-guard shields 50*a* and 50*b* can be described in one embodiment as resilient. Debris-guard shields 50*a* and 50*b* flex outwardly from connection point 44*e* around the notched open member 44*c*, and thus around pivot rod 26. Because debris-guard shields 50*a* and 50*b* have a width essentially equal to the diameter of drain flange 46 and drain body 48 and because flow diverters 50*a* and 50*b* are sufficiently stiff, flow diverters 50*a* and 50*b* press against the inside wall of the drain body 48 at an intermediate point between the pivot rod 26 and the radius of the drain body 48 in the plane of the image of FIG. 2.

As can be seen in FIG. 2, drain body 48 has a radius r in the plane of the image shown in FIG. 2. Debris-guard flow diverter 50*b* presses against the inside wall 48*a* of drain body 48 at an intermediate point such that a gap x is defined between an outside surface of debris guard 50*b* and inside wall 48*a* at the full radius r in the plane of the image shown in FIG. 2. In the cross-sectional side elevation shown in FIG. 2, pivot rod 26 is shown as lying in a longitudinal centerline, which is a distance r from the inside wall 48*a* in the plane of the image. The lower free end 50*d* of the hair guard 50*b* presses against the inside wall 48*a* at a distance of r minus x from the centerline in the plane of the image, and consequently a flow path is defined between an outside surface of the hair guard 50*b* and the inside wall 48*a* of drain body 48. The plan view in FIG. 2A shows the flow path in the gap x is defined by the debris guard 50*b* and the inside wall 48*a* of drain body 48. The lower end 50*d* of debris guard 50*b* is bent into the shape of a circular arc because its edges are pressed against the inside wall 48*a* of drain body 48 while the center portion is pressed further outwardly by notched open member 44*c*. The inside wall 48*a* of drain body 48 defines a circular arc that has a greater diameter than the circular arc shape of debris guard 50*b*. Consequently, the flow path in gap x has a crescent shape in this embodiment. All that has been described with reference to debris guard 50*b* is also the same for debris guard 50*a*, and consequently, a flow path is provided inside drain body 48 on each side of pivot rod 26, but not over pivot rod 26 or notched open member 44*c*, which retards accumulation of hair and other debris on pivot rod 26 and notched open member 44*c*. The result is reduced frequency of clogging of pop-up drain assembly 10*a*.

Figure 3:
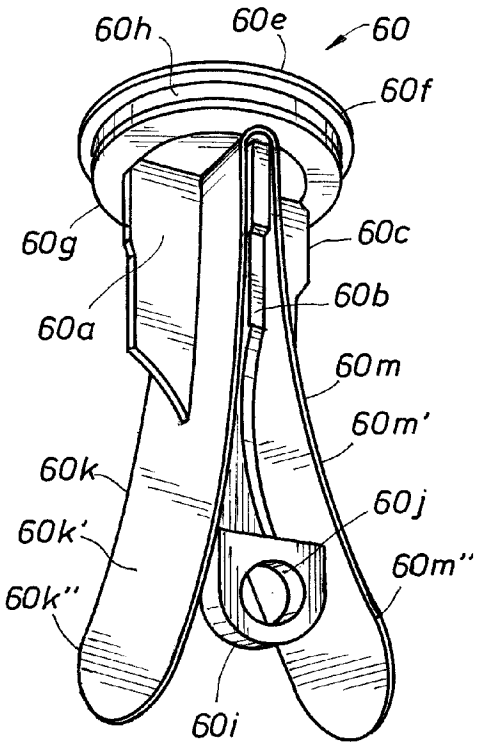
FIG. 3 is a perspective view of a drain stopper, according to the present invention.

FIG. 3 shows a side elevation of a stopper 60 in a perspective view. Stopper 60 has a central, elongate shaft from which fins 60*a*, 60*b*, 60*c* and 60*d*, which is not shown as it is hidden behind fins 60*a* and 60*b*. Stopper 60 has a cap 60*e* on an upper end, which has an outermost and uppermost domed flange 60*f*, lowermost and innermost flange 60*g* and a seal 60*h* between the flanges for sealing with a drain flange and retaining water in a sink. A pivot rod receiving element 60*i* is formed integral with the central shaft on a lower end opposite the cap 60*e* and has an opening 60*j* through which a pivot rod can be received so that the pivot rod can move the stopper 60 up and down between an open and a closed position, respectively. Pivot rod receiving element 60*i* could be notched as shown in FIG. 2 so that it could be pressed transversely onto the pivot rod. Another alternative is that the pivot rod holder could have the shape of the letter "J" such that there is a hooked end in which the pivot rod can be received. A pair of flow diverters or debris shields 60*k* and 60*m* are fastened onto the central shaft. While stopper 60 can be made of metal or plastic or a combination of metal and plastic, in this embodiment, the central shaft, the fins 60*a*, 60*b*, 60*c* and 60*d*, and the pivot rod receiving member 60*i* are formed by injection molding of a plastic such as polyethylene, polypropylene, polystyrene, polyvinylchloride or a copolymer of suitable monomers. Although shown as two separate pieces in other embodiments, in this embodiment, debris guards 60*k* and 60*m* are formed of a single integral piece of stiff, resilient plastic, such as polypropylene. A slot is formed or cut along a longitudinal centerline and extends about the half of the length of the debris guard, but is longitudinally centered. The width and length of the slot in the debris guard is determined by the need to fit over the fins 60*a* and 60*c*. The debris guard is folded at a longitudinal centerline and placed on the central shaft, receiving fins 60*a* and 60*c* through the slot in the debris guard. An adhesive is preferably used to fasten the debris guard to the central shaft at an upper end near the cap 60*e*, but if an adhesive fails, such as due to an incompatibility of materials, other mechanical and/or chemical means can be used to fix the debris guard on the central shaft defined by fins 60*a*, 60*b*, 60*c* and 60*d*.

Continuing to reference FIG. 3, the cap's lower flange 60*g* and seal 60*f* are sized to fit snugly in a drain flange for a sealing engagement that will hold fluid in a receptacle. The width of the debris guard 60*k*, 60*m* is about the same as the diameter of cap flange 60*g* and cap seal 60*f*, probably slightly smaller, but greater than the radius of the cap flange 60*g* and cap seal 60*f*. If the radius of the cap flange 60*g* and cap seal 60*f* is R, then the width of the debris guard ranges between 1.1R and 1.9R, preferably between 1.3R and 1.9R, more preferably between 1.5R and 1.8R. Some experimentation will likely be required, and a width of 1.75R may be a good starting point. The width should be such that fluid flow around stopper 60 is directed along an outside surface 60*k*' and 60*m*' of debris guards 60*k* and 60*m*, respectively. Debris guards 60*k* and 60*m* have a lower free-end portion 60*k*" and 60*m*", which may flex into an essentially vertical position while installed in a drain assembly, leaving a flow path along outer surfaces 60*k*' and 60*m*', while shielding pivot rod receiving element 60*i* from fluid and debris in the fluid, such as hair, toothpaste, oil and soap. The length and width of the debris guard relative to the diameter of the drain assembly will determine how the debris guard lies against the inside wall of the drain assembly. A longer debris guard will more likely flex into a vertical position in a lower end portion. A shorter debris guard may bend such that its lower edge is adjacent to the inside wall of the drain assembly. If a short debris guard is used, which does not flex into a vertical position in its lower end, one may wish to use a squared-off lower end rather than a rounded lower end, because if the lower end of the debris guards is squared off, this should ensure a larger semi-circular flow path as compared to a smaller crescent-shaped flow path that may result from a rounded bottom. A stopper with debris guards rounded at the bottom is easier to install in a drain, and debris guards that are long enough to flex into a vertical position around the pivot rod may be preferred.

Figure 6:
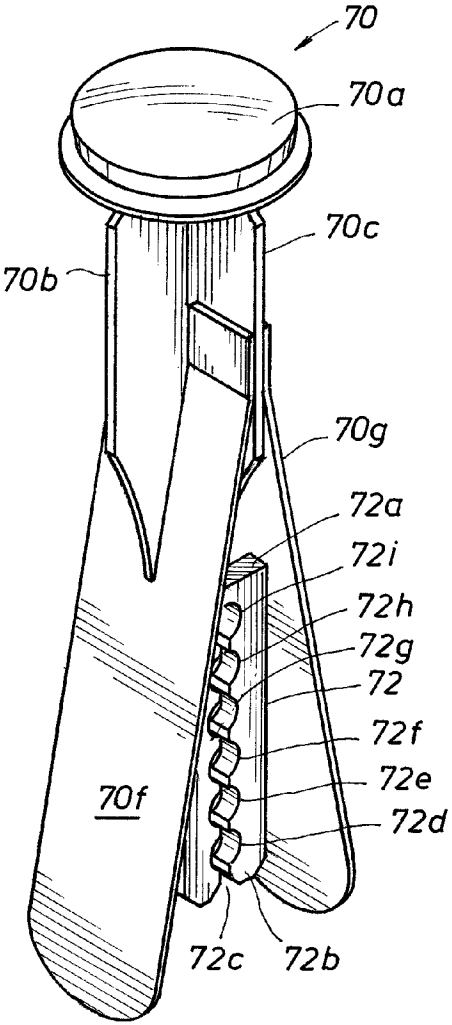
FIG. 6 is a perspective view of a drain stopper adapted to have different lengths, according to the present invention.
Figures 7, 8A, 8B, 9:
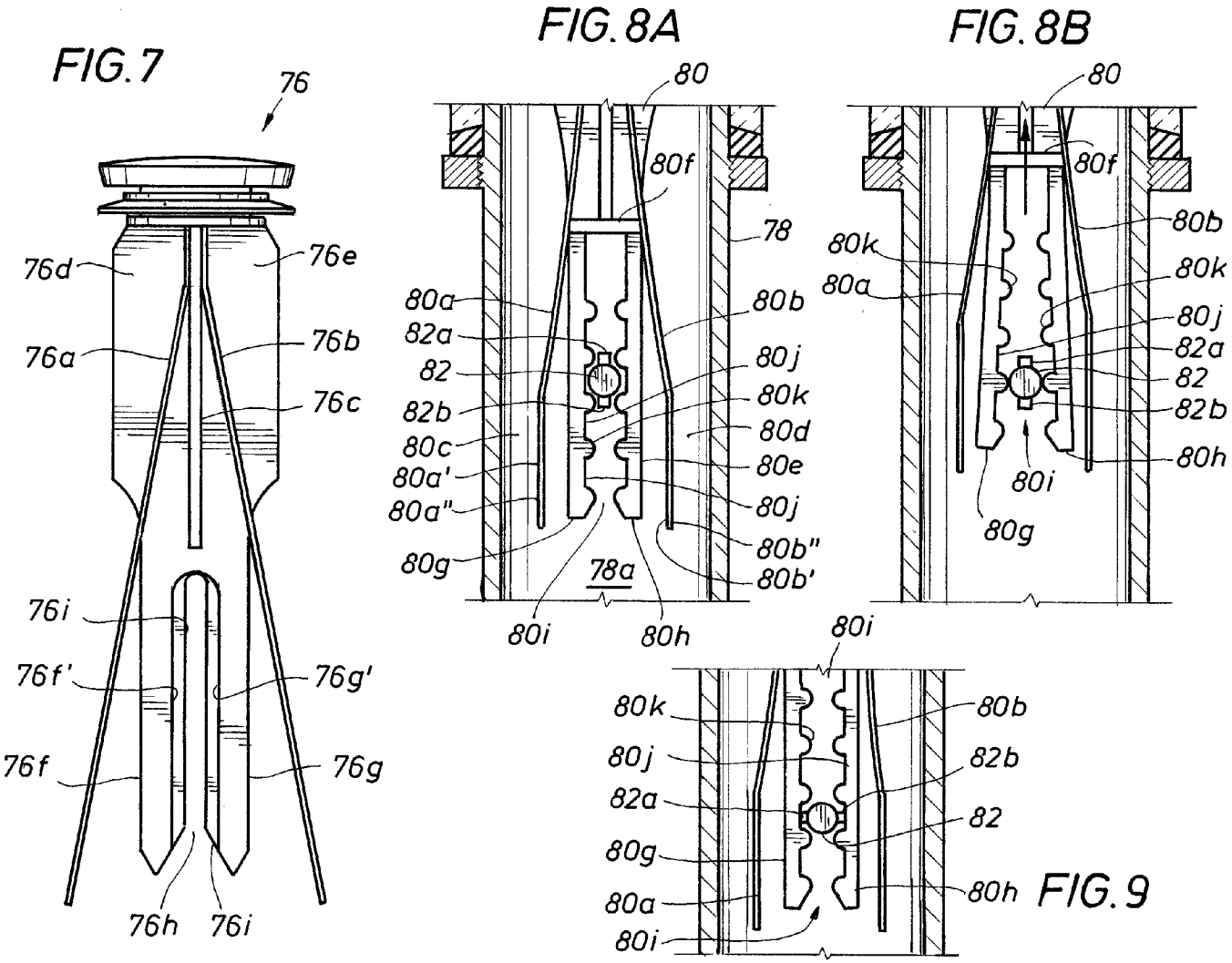
FIG. 7 is a side elevation of a drain stopper adapted to press onto a pivot rod transversely, according to the present invention.
FIG. 8A is a side elevation of a drain stopper adapted to press onto a pivot rod transversely, according to the present invention.
FIG. 8B is a side elevation of the drain stopper of FIG. 8A during assembly or disassembly, according to the present invention.
FIG. 9 is a side elevation of a drain stopper adapted to press onto a pivot rod transversely and to lock into engagement, according to the present invention.

The width of the debris guard or flow diverter is more appropriately compared to the inside diameter of the piping in which the stopper is received. A purpose for using a pair of opposing flow diverters on a stopper is to form somewhat of a seal between the flow diverters and the inside wall of the piping so that fluid flow is diverted away from the lower end of the stopper. The flow diverters provide a partial dam in the fluid flow path in the drain piping, and fluid flowing downwardly through the drain piping is directed toward the inside wall of the drain pipe and away from the lower end of the stopper. There is preferably a minimal clearance between the side edges of the flow diverters and the inside wall of the piping for providing somewhat of a seal between the flow diverters and the inside wall of the piping. The width, w, of the flow diverters could be as great as (or possibly greater than) the inside diameter of the piping, which is the drain flange and drain body in FIG. 1. It is believed that the width of the flow diverters should be at least as great as half the inside diameter of the piping, which is its radius, r. Then, the width of the flow diverters should range between about r and about 2r or so and is probably in the range of 1.4r to 1.8r. The length, L, of the flow diverter plates will likely be related to the length of the stopper, particularly the length below the cap. If the stopper has a body length of BL, then the length of the flow diverters will likely be as least as long as about 0.25BL and probably not longer than about 2BL. If a pivot rod holder, such as in FIGS. 6 and 7, is included as part of the body of the stopper, then L will be likely less than or equal to about 1.25BL and more likely to be less than or equal to 1.75BL, and preferably 0.5BL is less than or equal to L, which is less than or equal to 1.5BL. The thickness of the flow diverters will depend on the material of which the flow diverter is made. The flow diverter should form a seal with the inside wall of the piping. A sheet of standard copier paper is believed to be less than about 0.004 inches thick, which a sheet of cardstock is believed to be about 0.0175 inches thick. If a thin, stiff, flexible and resilient metal or plastic material is used, the thickness may be about 0.01 inch or about 0.25 mm. On the other hand, a thicker plate could be used, such as another plastic with a higher content of elastomeric material, which may be as much as one-eighth of an inch thick or about 3 mm, but probably no more than about one-sixteenth of an inch or about 1.5 mm thick. The thickness may be about 0.01 to 0.02 inches in one embodiment and may be from about 0.2 mm to about 1 mm, preferably to about 0.5 mm in another embodiment. The thickness of cardstock may be about right, depending on the material of construction. An example of a flow diverter is a rectangular plate having a length of from about 3 to 6 inches, and width of from about 0.75 to about 1.5 inches and a thickness of from about 0.01 to about 0.02 inches, where the plate is made of a material that will flex into an arc along a transverse section that has a radius of curvature equal to about the width of the plate, but is sufficiently stiff so that it will not readily flex into an arc having a radius of curvature of about half the width of the plate, and where the material is resilient so that it will return to the shape of a planar plate after a flexing force is removed.

Figure 4:
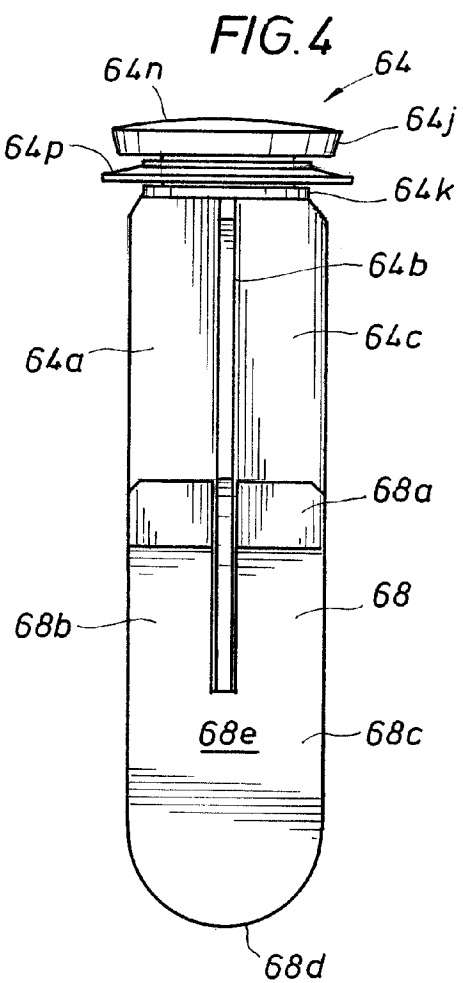
FIG. 4 is a side elevation of a drain stopper, according to the present invention.
Figure 5:
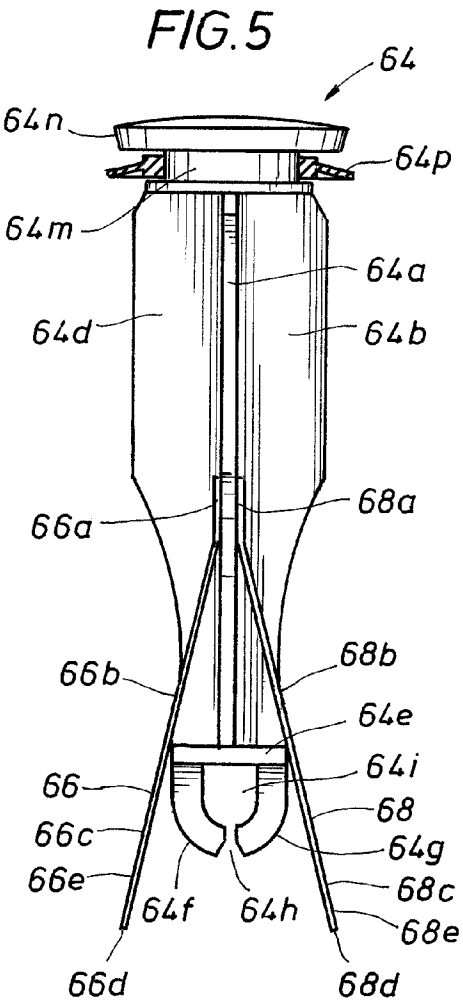
FIG. 5 is a side elevation of the drain stopper of FIG. 4 rotated 90 degrees.

FIG. 4 is a side elevation of a drain stopper 64, and FIG. 5 is another side view of drain stopper 64 after a 90-degree rotation about its longitudinal axis. Stopper 64 comprises two plates that intersect at a right angle to provide longitudinal flanges or fins 64*a*, 64*b*, 64*c* and 64*d*, which attach to a plate 64*e* on a lower end. Two downwardly projecting elements 64*f* and 64*g* are attached at an upper end to a lower surface of plate 64*e*, and the downwardly projecting elements 64*f* and 64*g* each have a free end that curves one towards the other so that together, the downwardly projecting elements 64*f* and 64*g* form a shape that resembles a semi-circle that is cut to leave a gap 64*h* in the center of its arc. Downwardly projecting elements 64*f* and 64*g* are stiff and resilient so that stopper 64 can be pressed onto a pivot rod from the side, and consequently, stopper 64 can be removed from a drain assembly for cleaning without needing to remove the pivot rod. Stopper 64 can be reinstalled by pressing the stopper downwardly while the gap 64*h* is aligned over the side of the pivot rod. Downwardly projecting elements 64*f* and 64*g* flex outwardly to accommodate the full diameter of the pivot rod in the gap 64*h* and then return to their normal state to retain the pivot rod in an interior opening 64*i* defined by the downwardly projecting elements 64*f* and 64*g* and plate 64*e*. Flow diverter plates 66 and 68 have an upper end portion 66*a* and 68*a* that is adhered to fins 64*a* and 64*c*. Flow diverter plates 66 and 68 flex outwardly through a central portion 66*b* and 68*b* in order to accommodate the width of lower plate 64*e*. Flow diverter plates 66 and 68 have a lower portion 66*c* and 68*c* and a lower end 66*d* and 68*d*. The flow diverter plates 66 and 68 are preferably of a stiffness, length and width such that the lower portion 66*c* and 68*c* is forced into an essentially vertical position. The flow diverter plates 66 and 68 have an outer surface 66*e* and 68*e*.

While stopper 64 is installed and in operation, two fluid flow pathways should be defined by flow diverter plates 66 and 68 and the inside wall of the drain assembly. The inside wall of the drain assembly is circular in a transverse cross-section and has a diameter of twice its radius or 2R. If the width of flow diverter plates 66 and 68 is about 1.4R to about 1.8 R, then lower portions 66*c* and 68*c* will press against the inside wall of the drain assembly and orient essentially vertically, provided the flow diverter plates 66 and 68 are sufficiently long. In this case, one fluid flow path will be defined as a semi-circular shape by outside surface 66*e* and the inside wall of the drain assembly, and another fluid flow path will be defined between outer surface 68*e* of diverter plate 68 and the inside wall of the drain assembly, which flow path will also have a semi-circular shape in a transverse cross-section.

Drain stopper 64 in FIGS. 4 and 5 further includes a cap portion 64*j* that includes a top plate 64*k*, which is attached to the top of the central shaft and the fins 64*a*, 64*b*, 64*c* and 64*d*, a cap shaft 64*m* extending upwardly from top plate 64*k*, and a domed flange 64*n* is affixed to or integral with an upper end of cap shaft 64*m*. A gasket or seal 64*p* is received around cap shaft 64*m* between top plate 64*k* and domed flange 64*n*. Gasket or seal 64*p* is typically made of an elastomeric material and provides a seal with a drain flange for retaining fluid in a receptacle. Gasket or seal 64*p* is shown in cross-section in FIG. 5.

FIG. 6 is a side elevation of a drain stopper 70 in a perspective view. Stopper 70 has a cap 70*a* and fins 70*b*, 70*c*, 70*d* and 70*e*, but fins 70*d* and 70*e* are not visible in FIG. 6. Flow diverter debris shields 70*f* and 70*g* are attached to fins 70*c* and 70*e* about midway along the length of the fins. The debris shields 66 and 68 in FIGS. 4 and 5 were attached to a lower end of the fins and shaft, while in FIG. 7 the debris shields are attached to an upper end of the stopper body.

Stopper 70 has a pivot rod retainer 72, which is shown as being about as long as the fins 70*b* and 70*c* but may be longer or shorter. Pivot rod retainer 72 is attached to or formed integral with a lower end of the shaft from which the fins 70*b* and 70*c* emanate radially. Pivot rod retainer 72 has an upper end 72*a*, where it is attached to or formed integral with the central elongate body of the stopper, and a lower end 72*b*. Pivot rod retainer 72 has an open slot 72*c* on lower end 72*b*, which extends upwardly for nearly the entire length of the pivot rod retainer 72. The body of the pivot rod retainer 72 defines the slot 72*c* and multiple circular openings sized to have a diameter only slightly larger than the diameter of a pivot rod. Stopper 70 and pivot rod retainer 72 can be pressed and forced onto a pivot rod transversely, and the multiple circular openings provide different distances between a pivot rod and the bottom of the cap 70*a*, which allows stopper 70 to fit different drain assemblies from different manufacturers. In this embodiment, pivot rod retainer 72 has openings 72*d*, 72*e*, 72*f*, 72*g*, 72*h* and 72*i* stacked one above the other along slotted opening 72*c*, which provides six different vertical distances between the bottom of a lavatory basin and a pivot rod in a drain assembly. The openings in the pivot rod retainer can be circular, oval, rectangular and/or triangular. Thus, stopper 70 can be used to retrofit an existing drain assembly with a stopper that reduces the likelihood of flow stoppage or clogging in the drain assembly.

FIG. 7 is another embodiment of a drain stopper according to the present invention. A side elevation of a drain stopper 76 is shown in FIG. 7, which has flow diverter debris shields 76*a* and 76*b* attached to an upper end of a radial flange 76*c*. An opposing radial flange can not be seen in this view. Opposing radial flanges 76*d* and 76*e* extend radially outwardly perpendicular to radial flange 76*c*, and the longitudinal intersection of the radial flanges define a central longitudinal shaft. Radial flange or fin 76*d* extends downwardly into a first prong 76*f*, and radial flange 76*e* extends downwardly into a second prong 76*g*. First and second prongs 76*f* and 76*g* are spaced apart and a slot 76*h* is defined between first and second prongs 76*f* and 76*g*. First and second prongs 76*f* and 76*g* have inside edges 76*f*' and 76*g*', respectively, and a layer of rubbery, elastomeric material 76*i* is bonded to the inside edges 76*f*' and 76*g*'. A gap remains within slot 76*h* between the elastomeric material 76*i* on first prong 76*f* and the elastomeric material 76*i* on the second prong 76*g*, and a pivot rod can be received in this gap by forcing stopper 76 transversely over a pivot rod that is extending or protruding into a drain assembly. The width of the gap between the elastomeric material is slightly less than the width or diameter of the pivot rod, while the width of slot 76*h* between first and second prongs 76*f* and 76*g* is slightly greater than the width or diameter of the pivot rod, which results in a snug or tight friction fit between the stopper 76 and the pivot rod. First and second prongs 76*f* and 76*g* and slot 76*h* can have different lengths relative to the central longitudinal shaft such as 0.25, 0.50, 0.75, 1.0, 1.25, 1.50, 1.75 and 2.0 times the length of the central longitudinal shaft. Slot 76*h* and the gap between the elastomeric material 76*i* within slot 76*h* have a length equal to essentially the length of first and second prongs 76*f* and 76*g*, which is from 1 to about 10 times the diameter of a pivot rod, preferably 1 to 6 times and more preferably 1 to 3 times the diameter of a conventional pivot rod that has a circular cross-section. A conventional pivot rod may range in size of from about 6 to about 12 inches in length, more typically from about 8 to about 10 inches in length, with a diameter ranging from about 0.125 inches to about 0.375 inches, where the diameter is typically about 0.25 inches.

FIGS. 8 and 9 illustrate an alternative design for a pivot rod and a pivot rod retainer on a drain stopper. FIG. 8A shows a cross-section side elevation of a drain assembly 78, and a side elevation of the lower portion of a drain plug 80. Drain plug 80 is fitted with a pair of clog preventers 80*a* and 80*b*. Drain assembly 78 has an inside wall 78*a* for which a horizontal cross-section would be circular, assuming drain assembly 78 is installed in a vertical position. Clog preventers 80*a* and 80*b* have a lower, vertical portion 80*a*' and 80*b*', respectively, while installed in a vertical drain assembly, due to the width and flexibility of the clog preventers, which causes the lower portions 80*a*' and 80*b*' of the clog preventers 80*a* and 80*b* to press against and rest against inside wall 78*a* of drain assembly 78. Clog preventers 80*a* and 80*b* have an outside surface 80*a*" and 80*b*", respectively, on a side opposite of where a pivot rod is received. A first flow pathway 80*c* is defined between the outer surface 80*a*" of debris shield or clog preventer 80*a*, and a second flow pathway 80*d* is defined between the outer surface 80*b*" of flow diverter or clog preventer 80*b*.

FIG. 8A shows a side elevation of a pivot rod holder 80*e* attached to a lower end of a plug body 80*f*. Pivot rod holder 80*e* has two parallel prongs 80*g* and 80*h*, which are spaced apart to provide a gap 80*i*. The inside walls of prongs 80*g* and 80*h*, which define gap 80*i*, have a series of notches 80*j*, and between a pair of adjacent notches 80*j* is a projection 80*k*. A pivot rod 82 having a pair of opposing longitudinal flanges 82*a* and 82*b* that project radially is received in a detent relationship in gap 80*i*. FIG. 8*b* shows the stopper and drain assembly of FIG. 8A, while stopper 80 is pushed into detent engagement with pivot rod 82. Pivot rod flanges 82*a* and 82*b* are in longitudinal alignment with the longitudinal centerline of gap 80*i* between prongs 80*g* and 80*h* while stopper 80 is pushed onto pivot rod 82. Projections 80*k* on prong 80*g* are opposite and facing projections 80*k* on prong 80*h* and are spaced apart a distance that is slightly less than the diameter of pivot rod 82, which requires that prongs 80*g* and 80*h* be forced apart somewhat while stopper 80 is pressed into engagement with pivot rod 82. FIG. 8A shows pivot rod 82 at rest between a pair of opposing notches 80*j* and between adjacent projections 80*k*. A pair of adjacent projections on first prong 80*g* opposes a pair of adjacent projections on second prong 80*h* and surround pivot rod 82 to hold and retain pivot rod 82 within pivot rod holder 80*e* in a detent relationship. A detent relationship is one in which one part is kept in a certain position relative to that of another, where one part can be released by applying force to one of the parts. FIG. 9 shows a portion of the pivot rod holder 80*e* of FIG. 8A and pivot rod 82. In FIG. 9 the pivot rod 82 has been rotated 90 degrees relative to the position of pivot rod 82 in FIG. 8A. Consequently, pivot rod flanges 82*a* and 82*b* are perpendicular to the longitudinal axis of slot 80*i*. Flanges 82*a* and 82*b* project sufficiently to force prongs 80*g* and 80*h* apart slightly, which provides a tighter engagement of pivot rod holder 80*e* with pivot rod 82 as compared to the arrangement in FIG. 8A. In FIG. 8A, the pivot flanges are 82*a* and 82*b* are aligned with the centerline of slot 80*i*, and in FIG. 9, the pivot flanges are 82*a* and 82*b* are transverse to the centerline of slot 80*i*, so the parallel alignment in FIG. 8A can be said to provide a soft detent hold on the pivot rod, and the transverse alignment in FIG. 9 can be said to provide pivot rod holder 80*e* a firm detent hold on pivot rod 82.

Figure 10:
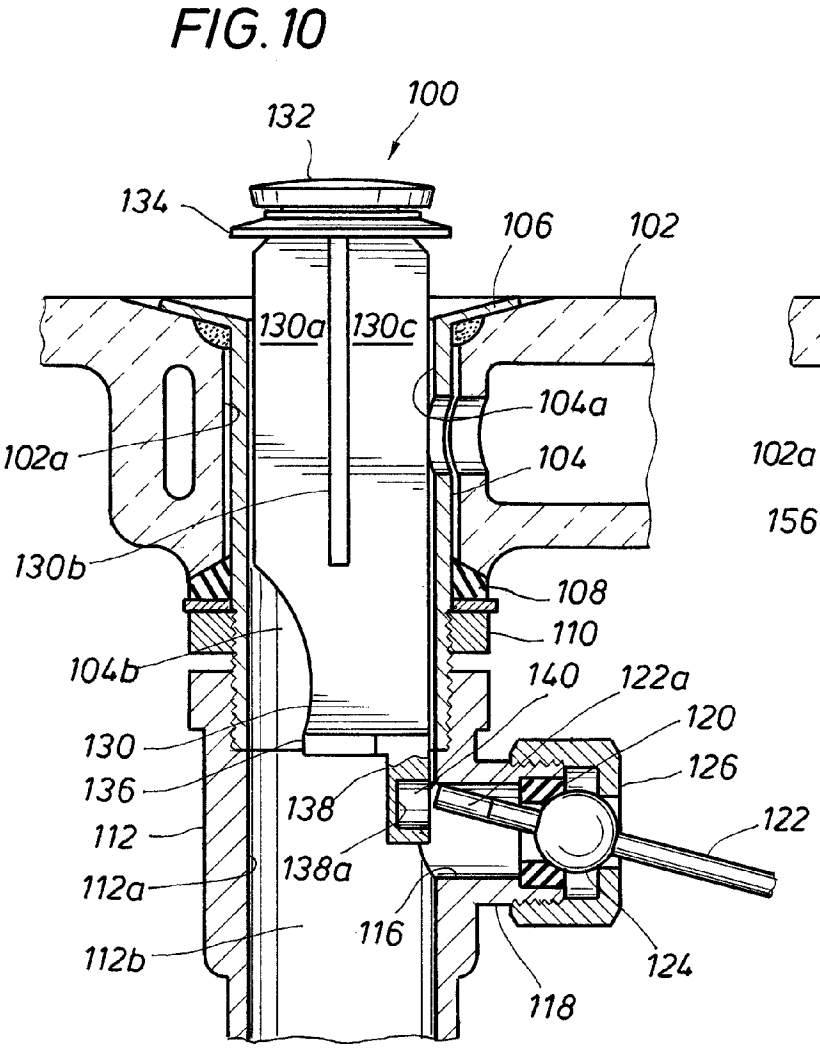
FIG. 10 is a cross-section of a side elevation of a drain stopper that has a magnet or magnetic material for magnetically coupling with a pivot rod, according to the present invention.

Turning now to FIG. 10, an embodiment of the present invention is shown in which a pivot rod and a stopper are magnetically coupled rather than physically engaged, where the pivot rod does not protrude significantly inside a drain assembly. A pop-up drain assembly 100 is shown according to the present invention, which is received in a basin, receptacle or sink 102 through a drain hole 102*a*. Drain assembly 100 comprises a drain flange 104 that fits down through drain opening 102*a* in sink 102. As described with reference to FIG. 1, drain flange 104 has a threaded tubular portion that extends essentially throughout its full length and a flange 106 extends radially outwardly on a top end. A gasket or plumber's putty provides a seal between a lower surface of flange 106 and the sink 102. A rubber gasket 108 and a washer 108*a* are placed around a bottom portion of drain flange 104 and then pressed tightly against a bottom surface of sink 102 with a threaded nut 110. A drain body 112 is threaded onto a lower end of drain flange 104. Drain flange 104 has an inside wall 104*a*, and drain body 112 each has an inside wall 112*a*, and these two inside walls define circular cylindrical spaces 104*b* and 112*b*, respectively. Drain body 112 has a wrench flange 112*a* for receiving a wrench for tightening and loosening drain body 112 with respect to drain flange 104. Drain body 112 has a pivot rod port 116, and a threaded tubular stub 118 projects radially outwardly from drain body 112. A pivot ball seal 120 is received in stub 118.

A pivot rod 122 has a stopper end 122*a* and an outer end 122*b*, which is not shown. A pivot ball 124 is sealingly received on pivot rod 26 closer to stopper end 122*a* than outer end 122*b*. Pivot rod 122 is received in stub 116 such that stopper end 122*a* does not protrude into the interior space 112*b* defined by the inside wall 112*a* of the drain body 112 or only protrudes slightly inside of inside wall 112*a*. The pivot rod ball 124 rests against pivot rod seal 120. A pivot rod cap 126 is threaded onto stub 118 sufficiently tightly to seal pivot ball 124 against pivot rod seal 120, but loose enough to allow pivot ball 124 and pivot rod 122 to pivot. The positioning of pivot ball 124 on pivot rod 122 may be made adjustable so that the end of pivot rod tip 122*a* is located flush with the inside wall 112*a* of drain body 112.

A drain stopper 130 is received in drain flange 104 and drain body 112. Stopper 130 has a cap 132 with a gasket 134 (shown in cross-section) for sealing with flange 106 of drain flange 104 to retain fluid in sink 102. Stopper 130 has a plug-type body as described above with radial flanges 130*a*, 130*b*, 130*c* and 130*d* extending the length of the body. A bottom horizontal plate 136 is adhered to or formed integral with the lower end of the body of stopper 136. A holder 138 (shown in partial cross-section) is bonded to or formed integral with the bottom horizontal plate 136 and extends downwardly along the inside wall 112*a* of drain body 112 in alignment with pivot rod port 116. Holder 138 has a recess 138*a*, and a magnet or magnetic material 140 is received in recess 138*a*. Pivot rod end 122*a* is made of a magnetic material or is a magnet also, and pivot rod end 122*a* is magnetically coupled or linked to or engaged with magnet or magnetic material 140, such that there is a magnetic attraction between pivot rod end 122*a* and magnet or magnetic material 140. Only one of magnet or magnetic material 140 and pivot rod end 122*a* needs to be a magnet, while the other may be magnetic material, but a stronger magnetic coupling will be achieved if both are magnets. Stopper 130 is shown in the open position in FIG. 10, and pivoting of pivot rod 122 such that pivot rod end 122*a* is lowered will move stopper 130 into a closed position. Pivoting of pivot rod 122 about pivot ball 124 such that pivot rod end 122*a* is raised (into the position shown in FIG. 10) will move stopper 130 into an open position. Consequently, drain assembly 100 is less likely to become clogged than a conventional pop-up drain assembly because the pivot rod is not in the fluid flow path, which coincides with much of the space 104*b* and 112*b* inside drain flange 104 and drain body 112, respectively. Hair and other debris cannot readily catch on and/or adhere to pivot rod end 122*a* because pivot rod end 122*a* does not protrude inside of inside wall 112*a* of drain body 112. In a preferred embodiment, a permanent magnet is received in recess 138*a* in holder 138, while end 122*a* of the pivot rod 122 is made of magnetic material that is attracted to the permanent magnet, but the reverse arrangement can be used. The stopper 130 is open and closed by pivoting pivot rod 122 up and down, while the end 122*a* of the pivot rod 122 is not physically engaged with stopper 130, but is instead magnetically engaged with stopper 130.

Figure 11:
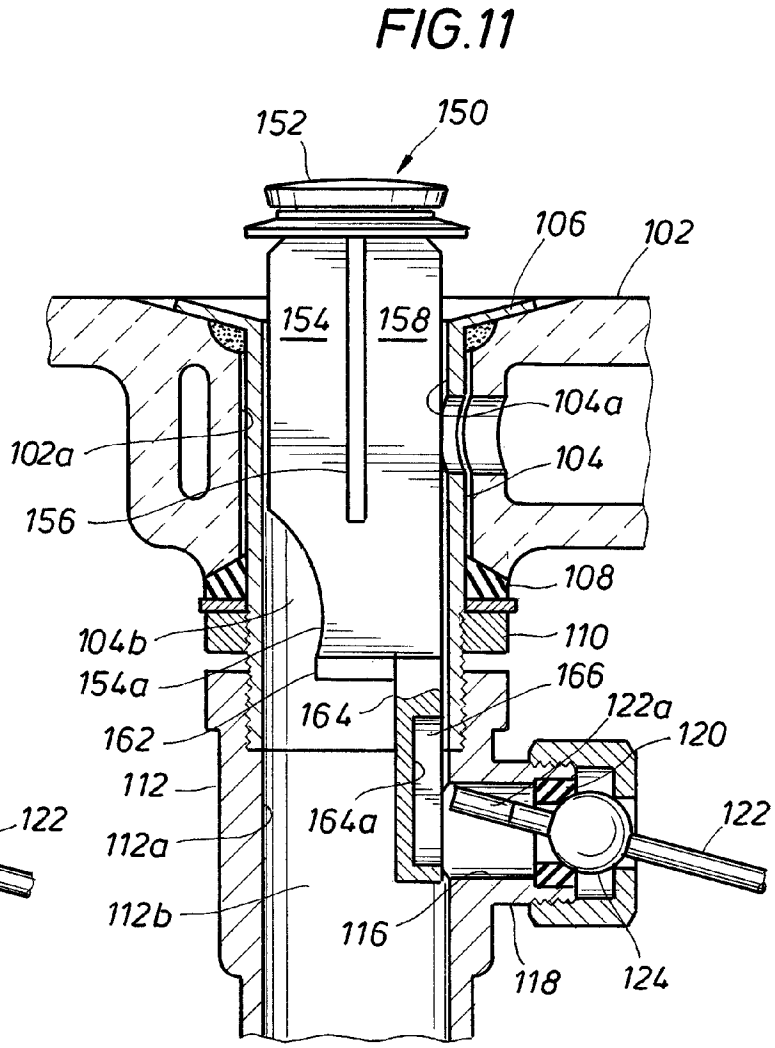
FIG. 11 is a cross-section of a side elevation of a drain stopper that has a length of magnet or magnetic material for magnetically coupling with a pivot rod, according to the present invention.

FIG. 11 shows a pop-up drain assembly 150 much like the drain assembly 100 in FIG. 10. The sink, drain flange, drain body and pivot rod are the same as described for FIG. 10 and have been given the same element numbers as described above with reference to FIG. 10. A stopper 152 is received in the drain flange and drain body shown in FIG. 11. The stopper 152 in FIG. 11 is not the same as the stopper 130 in FIG. 10. Stopper 152 has an elongate central shaft from which four fins 154, 156, 158 and 160 project radially outwardly. Stopper 152 could be made, such as by plastic injection molding, with 3, 4, 5, 6, 7, 8, 9 or 10 fins or flanges. Fin 154 tapers inwardly through a lower section 154*a* in a manner similar to the stoppers shown in FIGS. 2-7. Fin 158 does not taper inwardly and inside has an outside edge that remains adjacent to the inside wall 104*a* and 112*a* throughout its length. A lower plate 162 is bonded to or formed integral with the bottom edges of fins 154, 156, 158 and 160, as well as to a central shaft at the intersection of the fins. A holder 164 is bonded to or formed integral with lower plate 162 and possibly to fin 158. Holder 164 has a recess 164*a*, and holder 164 and recess 162*a* are preferably from about 2 to about 10 times as long as the diameter of pivot rod 122, preferably 3 to 8 times as long and more preferably 4 to 7 times as long. Stopper 152 in FIG. 11 differs from stopper 130 in FIG. 10 primarily in that holder 164 and recess 164*a* are longer than holder 138 and recess 138*a* in FIG. 10. This allows stopper 152 to fit drain assemblies of different lengths. The distance between the flange 106 at the surface of the sink 102 and the pivot rod 122 is different in drain assemblies from different manufacturers and between different models from the same manufacturer. The stopper 152 should be designed to fit many, if not all, of these different configurations. Either a permanent magnet or magnetic material 166 can be placed in recess 164*a*, and end 122*a* of pivot rod 122 can be either magnetic material or a permanent magnet, respectively, such that there should be a magnetic attraction between end 122*a* of pivot rod 122 and the magnet or magnetic material in recess 164*a* in holder 164 on stopper 152. A stronger magnetic coupling will be obtained if both are magnets and neither is merely a magnetic material. Pivoting of pivot rod 122 such that pivot rod end 122*a* moves up and down should correspondingly move stopper 152 up and down between an open position and a closed position, respectively. For further information, see U.S. Patent Application Pub. Nos. 2010/0154114 published Jun. 24, 2010, for inventors Van Zeeland and Sims entitled "Magnetic Drain Assembly" and 2009/0255041 published Oct. 15, 2009, for inventor Duncan entitled "Magnetically Actuated Drain Stopper Apparatus," each of which is incorporated by reference.

Figure 12:
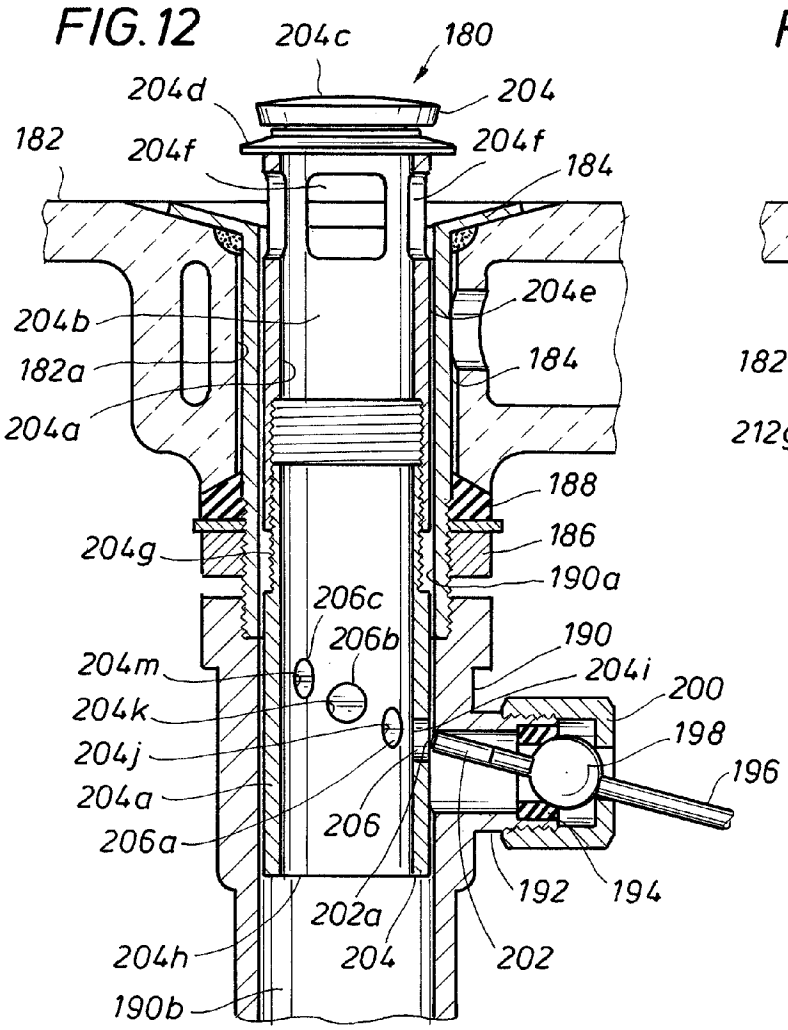
FIG. 12 is a cross-section of a side elevation of a tubular drain stopper that has several magnets or discs of magnetic material for magnetically coupling with a pivot rod, according to the present invention.

FIG. 12 is a cross-section of a side elevation of a pop-up drain assembly 180, according to the present invention. A basin 182 has a drain opening 182*a*. A drain flange 184 is received in drain opening 182*a* and held in place by a threaded nut 186, which presses against a gasket 188. A drain body 190 extends below drain flange 184 and has an inside wall 190*a*. Drain flange 184 and drain body 190 together form a piping that defines a circular cylindrical flow path for draining water or another fluid from basin 182. Drain body 190 has a pivot rod port and a stub 192 projects radially outwardly from drain body 190. A pivot ball seal 194 is received in stub 192. A pivot rod 196 and a pivot ball 198, which is in a sealing engagement with pivot rod 196, is received within stub 192 such that pivot ball 198 sealingly and moveably rests against pivot ball seal 194. A pivot assembly cap 200 holds pivot ball 198 against pivot ball seal 194. Pivot rod 196 has a tip 202 that is inside stub 192. A distal end 202*a* (with respect to pivot ball 198) extends inside stub 192 and terminates essentially flush with drain body inside wall 190*a*. Drain body inside wall 190*a* defines a circular cylindrical volume or space 190*b*. Distal end 202*a* may extend into drain body space 190*b* by as much as 10 mm, preferably no more than 50 mm, and more preferably no more than 3 mm, but is preferably flush plus or minus about 1 or 2 mm, although a large drain body may require tip 202*a* to extend further within space 190*b*.

A stopper 204 is received in drain assembly 184 and drain body 190. Stopper 204 has a stopper body 204*a* that is tubular in shape such that the wall of the body defines a circular, cylindrical, empty space 204*b* within the body 204*a*. A cap 204*c* having a gasket 204*d* is received on an upper end of tubular body 204*a*. An upper body tube 204*e* has two, three or four or more ports or openings 204*f* (which could be slots or a screen) located at an upper end just below cap 204*c* through which fluid in basin 182 can drain. Upper body tube 204*e* has an opposing lower end, which is threaded, and a lower body tube 204*g* has an upper end that is threadedly engaged with the lower end of upper body tube 204*e* such that the upper and lower body tubes thread together to form a unified piece of pipe or tubing. Lower body tube 204*g* is open at its lower end 204*h*. Lower body tube 204*g* has several recesses 204*i*, 204*j*, 204*k* and 204*m* spaced apart radially and longitudinally such that a line passing through the recess traces a spiral shape on an outer surface of lower body tube 204*g*.

A permanent magnet or magnetic material 206 is received in recess 204*i* on lower body tube 204*g*. The permanent magnet or magnetic material 206 is located in close proximity to distal end 202*a* of tip 202 on pivot rod 196. Tip 202 on pivot rod 196 is made of magnetic material or is a permanent magnet so as to be opposite of permanent magnet or magnetic material 206 such that there is a magnetic attraction between tip 202 and permanent magnet or magnetic material 206, which provides a magnetic coupling or engagement between pivot rod 196 and stopper 204. Through this magnetic coupling, one can pivot pivot-rod 196 down and up to move stopper 204 up and down to open and close the seal between gasket 204*d* and drain flange 184. Additional permanent magnets or magnetic material 206*a*, 206*b* and 206*c* is received in recesses 204*j*, 204*k* and 204*m*, respectively. Several magnets or magnetic material at different longitudinal locations allows stopper 204 to fit different manufacturer's drain assemblies, where there may be a difference in the distance between the center of pivot rod port and stub 192 (and hence the pivot rod 196) and the upper end of drain flange 184, which is flush with a drain surface of basin 182. The threaded engagement of upper body tube 204*e* and lower body tube 204*g* provides further adjustability to fit different manufacturer's drain assemblies, but the threaded engagement is optional, and a single piece of pipe or tubing could be used instead.

Figure 13:
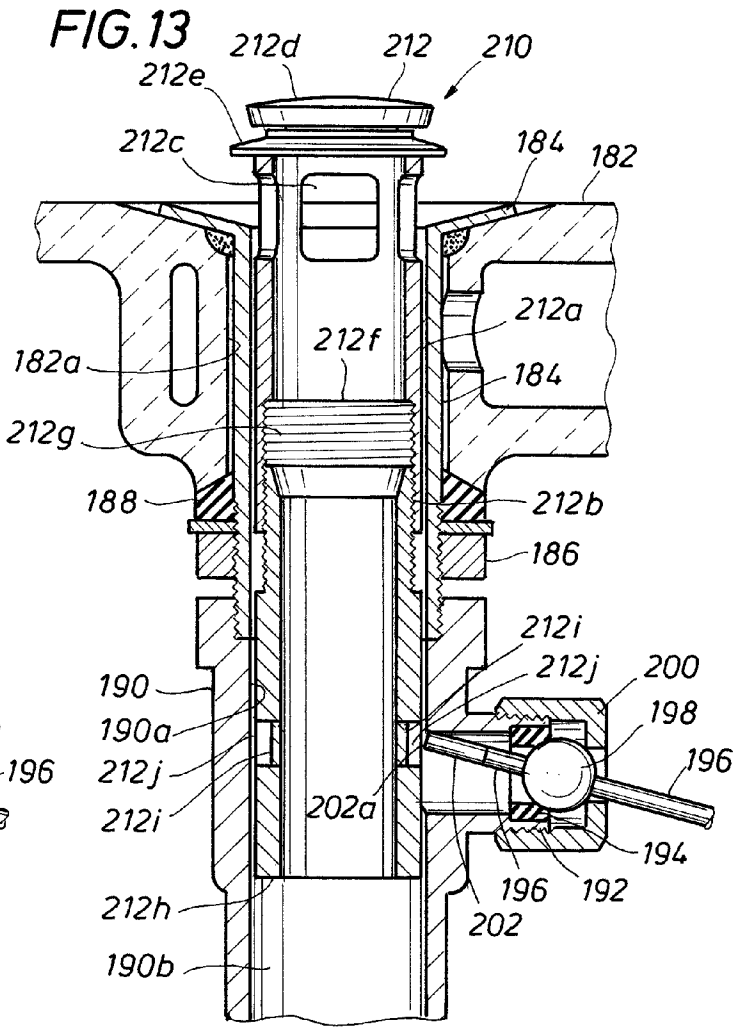
FIG. 13 is a cross-section of a side elevation of a tubular drain stopper that has a magnets or a disc of magnetic material for magnetically coupling with a pivot rod, and the length of the tubular drain stopper is adjustable, according to the present invention.

FIG. 13 is a side elevation of a pop-up drain assembly 210, according to the present invention. The sink, drain flange, drain body, pivot rod assembly and pivot rod are the same as for pop-up drain assembly 180 in FIG. 12, and like elements bear like numbers. Pop-up drain assembly 210 has a drain stopper 212 that is different from stopper 204 in FIG. 12, although it is similar. Stopper 212 has an upper tubular body 212*a*, which is threaded at a lower end 212*b* and which has one or more ports or openings 212*c* at an upper end through which water or fluid can pass into the inside of stopper 212. A cap 212*d* having a gasket 212*e*, which is shown in cross-section, is fixed to an upper end of upper tubular body 212*a*. A lower tubular body 212*f* having a threaded upper end 212*g* (shown partially without cross-section) is threaded onto the lower end upper tubular body 212*f*, although a single unified body could be used. Lower tubular body 212*f* is open at a lower end 212*h* so that fluid retained in basin 182 can flow into openings 212*c*, through the interior of upper tubular body 212*a*, lower tubular body 212*f* and out the open end 212*h*. Lower tubular body 212*f* has a circumferential recess or groove 212*i*, which is proximate to the pivot rod port in the drain body 190 while the stopper 212 is installed and operational. Either a ring of magnetic material or permanent magnet 212*j* or a plurality of discrete portions of magnetic material or permanent magnet 212*j* is received in groove 212*i*. The ring of magnetic material or permanent magnet 212*j* or a plurality of discrete portions of magnetic material or permanent magnet 212*j* is magnetically coupled to or engaged with tip 202 of pivot rod 196 so that pivot rod 196 can lift stopper 212 up and pull it down. The ring 212*j* allows stopper 212 to rotate about a longitudinal axis, while remaining magnetically engaged with or coupled to distal end 202*a* of tip 202 of pivot rod 196.

Figure 14:
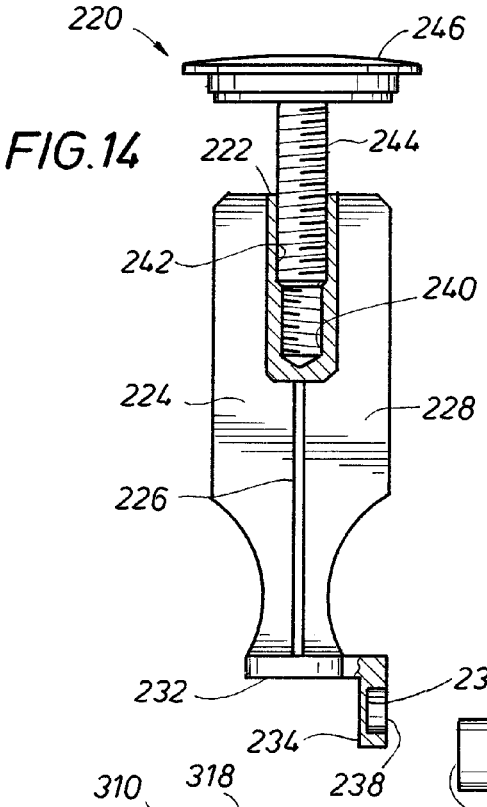
FIG. 14 is a side elevation of a drain stopper that has a magnet or magnetic material, and the length of the tubular drain stopper is adjustable, according to the present invention.

FIG. 14 is a side elevation in partial cross-section of a stopper 220, according to the present invention. Stopper 220 has a central longitudinal shaft 222 and four longitudinal fins 224, 226, 228 and 230 (hidden in back) radiate outwardly from shaft 222 forming two intersecting, perpendicular planes in a transverse cross-section. The longitudinal fins have a top portion and a bottom portion, which is not as wide as the top portion because each fin tapers inwardly through a curved arc in the bottom portion. A bottom plate 232 is bonded to or formed integral with a bottom edge of shaft 222 and fins 224, 226, 228 and 230. A holder 234 is bonded to or formed integral with plate 232 at an outer edge of plate 232. Holder 234 has a longitudinal axis that is parallel to the longitudinal axis of the shaft 222. A recess 236 is provided in holder 234, and a magnet or magnetic material 238 is received in recess 236 for magnetic engagement with a pivot rod as described above. The central longitudinal shaft 222 has a bore 240, and an inside wall 242 that defines bore hole 240 is threaded. A fully threaded rod or stud 244 has male threads threaded into the female threads in the wall 242. A cap 246, which would have a gasket that is not shown, is secured to the upper end of threaded rod 244, such as by threading, integral formation, welding or gluing. Rod 244 can be screwed to a desired depth to give stopper 220 a desired length so that stopper 220 will fit different manufacturer's drain assembly. Alternatively or additionally, bottom plate 232 (and holder 234) can be attached to the bottom edge of shaft 222 and fins 224, 226, 228 and 230 by a similar threaded rod and threaded borehole arrangement for providing a variable length for stopper 220. The means for adjusting the length of a stopper body described in reference to FIGS. 12-14 can also be incorporated in the stoppers described in reference to FIGS. 1-9, including having a two-piece, threaded shaft in which the length of the shaft can be adjusted.

Figure 15:
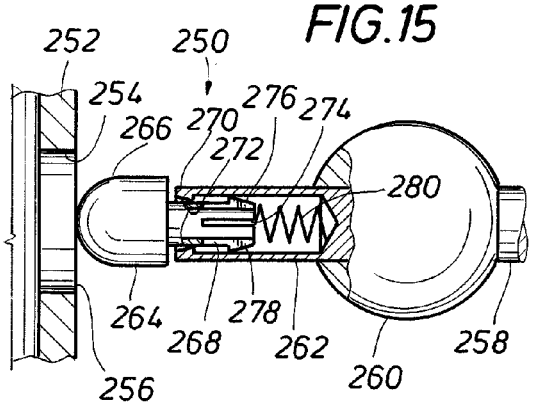
FIG. 15 is a side elevation of a pivot rod magnetically coupled to a drain stopper, wherein the pivot rod has a tip that is pressed against the drain stopper by a spring, according to the present invention.

FIG. 15 shows a side elevation in partial cross-section of a magnetic coupling assembly 250, according to the present invention. A cross-section of a small portion of a stopper 252 has a recess 254 in which is received a magnet or magnetic material 256. A drain body with a pivot rod port, pivot rod stub and pivot ball holder assembly is not shown for simplification. A side elevation in partial cross-section of a pivot rod 258 is shown, and a pivot ball 260 having a central bore is received on pivot rod 258. A seal is formed between pivot ball 260 and pivot rod 258. Pivot rod 258 has an end portion 262, which is a hollow, tubular portion. The remainder of pivot rod 258 may be a hollow tube or may be solid. A tip 264 has a bulbous head 266 formed integral with a shaft 268. A distal end 270 of end portion 262 has a shoulder 272 that projects inwardly about the circumference of the end 270 of pivot rod 258. Shaft 268 has a longitudinal slot 274 on an end 276 distal to head 266 and a radially outwardly projecting shoulder 278 about the circumference. Tip 264 can be pressed into engagement with end portion 262 of pivot rod 258. End 276 of shaft 268 of tip 264 is pushed inside distal end 270 of end portion 262 of pivot rod 258. Slot 274 allows shaft 268 of tip 264 to compress sufficiently so that outwardly projecting shoulder 278 passes through inwardly projecting shoulder 272, after which shaft 268 expands back to its normal diameter. After shoulder 278 of shaft 268 has passed to the interior of shoulder 272 of end portion 262 of pivot rod 258, tip 264 is locked into engagement with end portion 262 of pivot rod 258 because shoulder 272 on end portion 262 blocks the exit of shoulder 278 on tip 264. A spring (or resilient material) 280 is retained inside end portion 262. Spring 280 pushes against a solid portion within pivot rod 258 to push tip 264 outwardly so that head 266 remains adjacent to and/or is in contact with magnet or magnetic material 256 on stopper 252. Moving pivot rod 258 up and down moves stopper 252 down and up through magnetic coupling between tip 264 and stopper 252. Tip 264 is made of either magnetic material or a permanent magnet, opposite of the magnet or magnetic material 256 so that there is a magnetic attraction between tip 264 and stopper 252.

Figure 16:
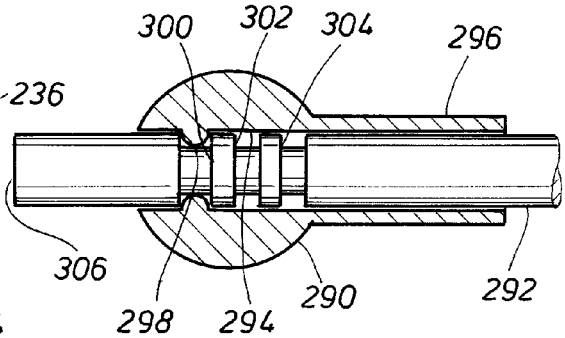
FIG. 16 is a side view of a pivot rod and a pivot ball shown in cross-section, where the pivot ball is fixed to the pivot rod by a detent mechanism, according to the present invention.

FIG. 16 is a side elevation of a pivot ball 290 (in cross-section) received on a pivot rod 292. Pivot ball 290 has a bore 294 through it and a hollow cylindrical extension 296. Pivot ball 290 has a shoulder 298 that projects inwardly into bore 294 and extends around the interior circumference of the wall that defines bore 294. Pivot rod 292 has circumferential grooves 300, 302 and 304 that can matingly receive shoulder 298 in a detent relationship. Pivot rod 292 has a distal end 306 for magnet coupling with a stopper. The detent fastening of pivot ball 290 onto pivot rod 292, where the pivot rod has multiple grooves spaced longitudinally apart for receiving the shoulder 298, allows the distance between the pivot ball 290 and distal end 306 of pivot rod 292 to be adjusted to fit different spacings that different manufacturers may have between a pivot ball and the inside wall of a drain body. The hollow cylindrical extension 296 on pivot ball 290 is optional. Alternative means for adjusting the distance between a pivot ball and the adjacent distal end of a pivot rod is a threaded connection, a friction fit and an easy slip-on ball with a set screw connection.

Figure 16A:
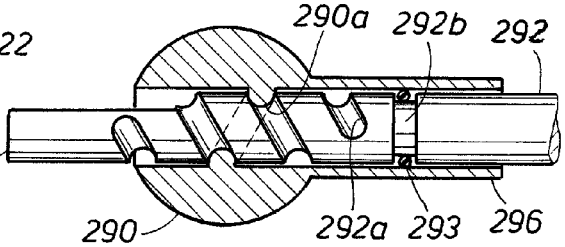
FIG. 16A is a side view of a pivot rod and a pivot ball shown in cross-section, where the pivot ball is connected to the pivot rod by a threaded connection, according to the present invention.
Figure 16B:
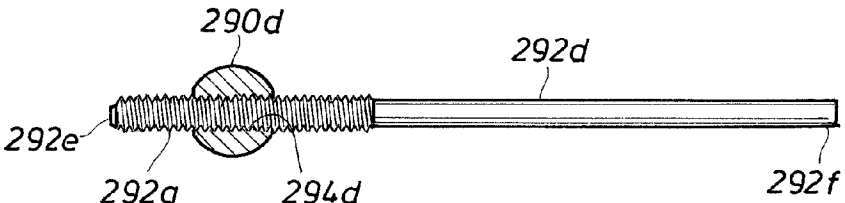
FIG. 16B is a side view of a pivot rod and a pivot ball threaded onto the pivot rod, according to the present invention.

FIG. 16A is very similar to FIG. 16, but instead depicts a threaded connection between pivot rod 292 and pivot ball 290. Pivot rod 292 has a spiral groove 292*a* on at least a portion of its surface, which provides threads, and pivot ball 290 has internal threads 290*a* for engagement with the threads on the pivot rod. Distal end 306 has a smaller diameter than the threaded portion of the pivot rod 292 for passing through the pivot ball 290. The extension 296 is optional, but useful for providing an O-ring seal between the pivot rod and the pivot ball, in which case the pivot rod has a circumferential groove 292*b* in which is received an O-ring 293, which forms a seal with an unthreaded, smooth-walled extension 306. An alternative to threading pivot ball 290 and extension 206 is to use a material and to have an inside diameter in the pivot ball and extension that will allow threads to be created while the threaded rod is threaded into the pivot ball 290. FIG. 16B is a side elevation of a pivot ball 290*d* (in cross-section) received on a pivot rod 292*d*. Pivot ball 290*d* has a bore 294*d* through it. Pivot rod 292*d* has a stopper end 292*e* and an outer end 292*f*. Pivot rod 292*d* has external threads 292*g* that extend from the stopper end 292*e* toward the outer end 292*f*. The pivot ball 290*d* has mating internal threads that define the bore 294*d*. The pivot rod 292*d* can be threaded through the pivot ball 290*d* a desired amount to provide a desired distance between the pivot ball 290*d* and the stopper end 292*e* of the pivot rod 292*d*.

Figure 17:
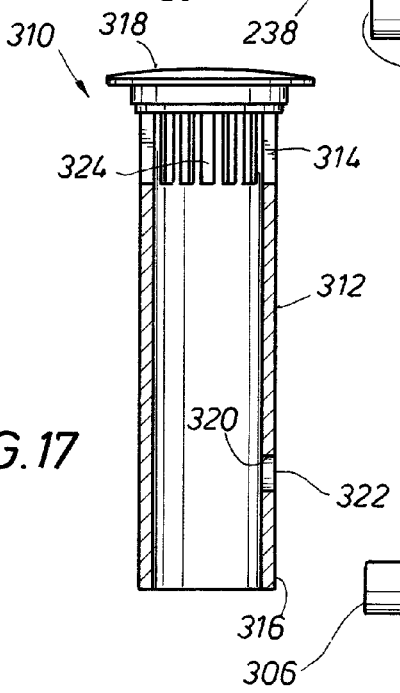
FIG. 17 is a cross-section of the tubular drain stopper shown in a side elevation with a magnet or a piece of magnetic material, according to the present invention.

FIG. 17 is a side elevation of a stopper 310 in partial cross-section. Stopper 310 has a hollow, cylindrical tubular body 312, which has an upper end 314 and a lower end 316. A cap 318 is fixed to upper end 314, and tubular body 312 has a hole, recess or indentation 320 for receiving a magnet or magnetic material 322. The upper end 314 of the tubular body 312 has a plurality of slotted openings 324 spaced together closely through which fluid, typically water, may pass, but which screens out debris, waster and objects that are too large to pass through the slotted openings 324. Slotted openings 324 are located around the entire circumference of the upper end 314 of tubular body 312. If a person's ring is dropped in a sink in which stopper 310 is installed, the upper end 314 serves as a screen to block entry of the ring into the interior of the tubular body 312. Long hair that falls into the sink may be caught in slotted upper end 314 as water flows into tubular body 312. Alternatively, a mesh screen can be used instead of the slotted openings 324. Alternative means for screening includes installing a horizontal mesh screen in a transverse cross-section of the lower end 316 of tubular body 312 or along the open end of lower end 316, in which case tubular body 312 becomes a basket for catching things such as hair that enter stopper 310, and in which case large ports would be provided in upper end 314 rather than slots 324.

Figure 18:
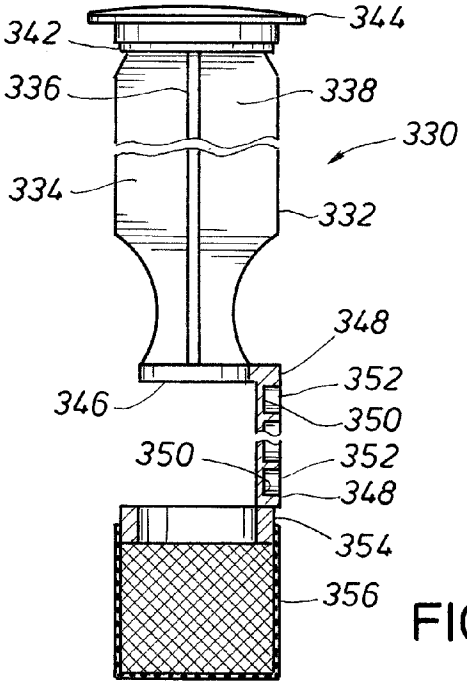
FIG. 18 is a side elevation of a drain stopper having an extension and magnets or magnetic material in the extension and a basket screen attached to the extension, according to the present invention.

FIG. 18 is a side elevation of a drain stopper 330, according to the present invention, which is similar to stopper 152 shown in FIG. 11 and described above. Stopper 152 in FIG. 11 was described as having a single linear magnet or magnetic material, but a plurality of magnets or magnetic material can be used. Stopper 330 has a plug-type body 332 comprised of a central shaft from which longitudinal flanges 334, 336, 338 and 340 (hidden) project radially. A top plate 342 is attached to the upper end of the central shaft and the longitudinal flanges 334, 336, 338 and 340. A cap 344 is received on the top plate 342. A bottom plate 346 is attached to the lower end of the central shaft and the longitudinal flanges 334, 336, 338 and 340. A receptacle member 348 extends downwardly from bottom plate 346 for a distance of about 0.25 to about 20, preferably about 0.5 to about 12 and more preferably from about 0.75 to about 5 times the diameter of the body 332. Receptacle member 348 has a plurality of recesses 350, and each recess 350 contains a permanent magnet or magnetic material 352. Alternatively, a single linear magnet or magnet material having approximately the length of the receptacle member 348 can be used. A cylindrical ring 354 is attached to or formed integral with the lower end of the receptacle member 348. A mesh basket 356 is attached to a lower end of ring 354. Mesh basket 356 provides a screen for catching objects, debris, hair and waste. Since stopper 330 will be magnetically coupled to a pivot rod, stopper 330 can be easily removed from a drain, cleaned and reinstalled. Alternatively, a screening mechanism can be used on an upper end of stopper body 332.

Figure 19:
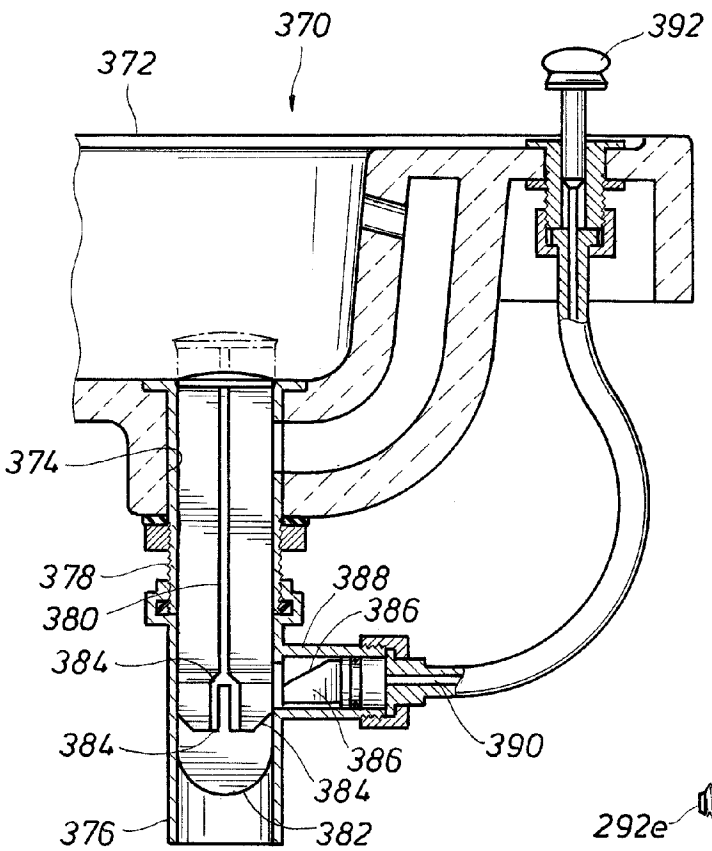
FIG. 19 is a cross-section of a side elevation of a sink or basin and a pop-up drain assembly, according to the present invention.

FIG. 19 shows an alternative means for opening and closing a stopper. The present invention has been described with reference to a pop-up drain in which a pivot rod is used to open and close the stopper. However, one skilled in this art would know a number of alternative means for opening and closing the stopper. FIG. 19 is a side elevation in partial cross-section showing a drain assembly 370, according to the present invention. FIG. 19 shows a prior art drain assembly disclosed in U.S. Pat. No. 3,002,196, issued to Mackey, Jr., which is incorporated by reference, as modified according to the present invention. In FIG. 19, a lavatory bowl 372 has a drain opening 374 and piping 376 is received in bowl 372 through opening 374. A stopper 378 has an elongate body from which a plurality of elongate fins 380 extend radially. A lower end of a flow diverter 382 is visible in the drawing. Debris-guard, debris shield, or flow diverter 382 is made, attached to stopper 378 and used as described above with reference to FIGS. 1-9. However, stopper 378 is not opened and closed by a pivot rod. Each of the fins 380 of stopper 378 have a split end 384, and a wedge-shaped cam 386 is received in one of the split ends 384. Cam 386 slides within a neck 388, and a cable 390 connects a control knob 392 to cam 386. As cam 386 is pushed inwardly by pressing downwardly on control knob 392, cam 386 slides into split end 384 of stopper 378 and lifts stopper 378 into an open position. As cam 386 is pulled outwardly by pulling upwardly on control knob 392, cam 386 slides out of split end 384 of stopper 378, and stopper 378 falls by gravity into a closed position. A pair of opposing guard shield flow diverters 382 divert water from bowl 372 around cam 386 and the lower split ends 384 to prevent debris, particularly hair, from accumulating on cam 386 and lower ends 384. Other means for opening and closing a stopper include electromechanical means, electric and magnetic means, and a spring-loaded detent mechanism. The following patents and patent applications describe various drain and stopper arrangements, different means for opening and closing stoppers and different means for controlling a pivot rods, and each of the following patents and patent applications is incorporated by reference: U.S. Pat. No. 773,408, issued to Moore; U.S. Pat. No. 1,980,250, issued to Baxter; U.S. Pat. No. 6,219,861, issued to Chen; and U.S. Pat. No. 6,308,351, issued to Franke; and U.S. Patent Application Publication Nos. 2003/0041374, listing Franke as inventor; and 2006/0179564, listing Jacobs as inventor. Means for moving a stopper in a drain include a pivot rod, a cam system, an electromechanical system, an electric-magnetic system, a human-manual system, a detent mechanism or a spring-loaded detent mechanism. The human-manual system is one in which a person holds the stopper and moves it between an open position and a closed position.

Figure 21:
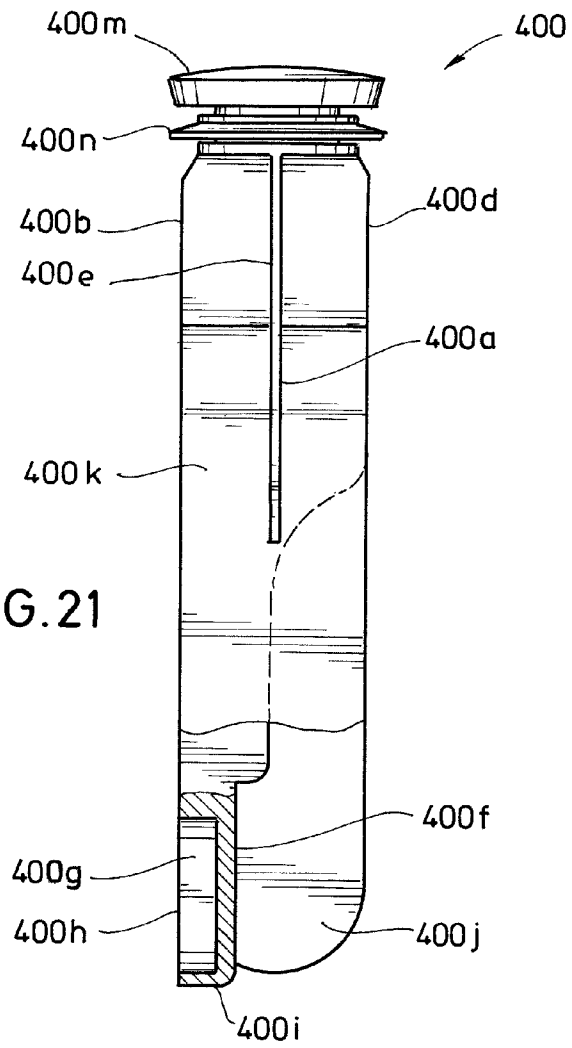
FIG. 21 is a side elevation of the drain stopper of FIG. 20 rotated 90°.
Figure 20:
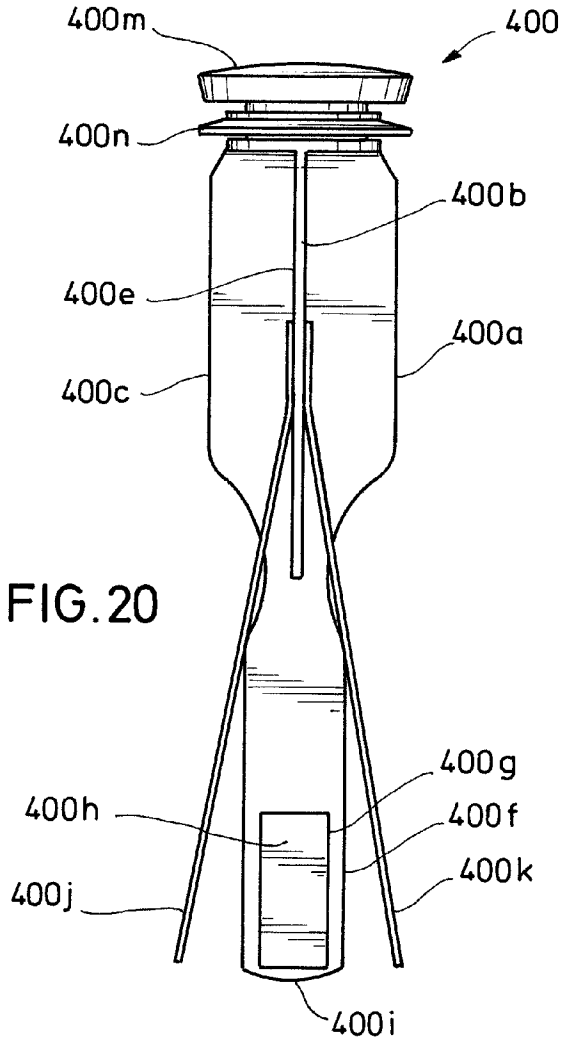
FIG. 20 is a side elevation of a drain stopper having a pair of opposing flow diverter plates, a magnet holder and a magnet or magnetic material in the magnet holder, according to the present invention.

Additionally, the debris guard flow diverters described with reference to FIGS. 1 to 9 can be used in conjunction with the magnetic coupling described with reference to FIGS. 10, 11, 14 and 18 for stoppers having plug-type bodies. FIG. 20 is a side elevation of a drain stopper 400, which has four longitudinal fins or flanges 400*a*, 400*b*, 400*c* and 400*d* that extend radially from a central, longitudinal shaft 400*e* at the intersection of the fins. The fins extend radially outwardly and define an outermost circumference of the stopper 400, A magnet holder 400*f* extends downwardly from fin 400*b*. A magnet or magnetic material 400*g* is received in a recess in the holder 400*f*, Magnet holder 400*f* and/or the magnet or magnetic material 400*g* has an outer, longitudinal surface 40011, which is aligned with the outermost circumference of the stopper 400, Magnet holder 400*f* has a lower end 400*i*. A pair of opposing flow diverter plates 400*j* and 400*k* are bonded to longitudinal fins 400*b* and 400*d*, Magnet holder 400*f* and the magnet or magnetic material 400*g* are located between the flow diverter plates 400*j* and 400*k*, which extend downwardly to the lower end 400*i* of the magnet holder 400*f* and shield the magnet holder 400*f* and the magnet or magnetic material 400*g* from water and debris flowing downwardly around the stopper 400. A cap 400*m* and a sealing gasket 400*n* are received at and adjacent to an upper end of the shaft 400*e*, FIG. 21 is a side elevation of drain stopper 400 in FIG. 20 rotated ninety degrees clockwise as viewed from looking down on the cap 400*m*. The various embodiments of the present invention are believed to effectively address a problem of clogging in sink and basin pop-up drain assemblies, particularly in that the pivot rod is not in the fluid flow pathway in the drain assembly. Fluid flow is diverted around the pivot rod that protrudes into the fluid flow path using debris shield flow diverter plates, or the pivot rod does not protrude significantly into the fluid flow path and is magnetically coupled to the stopper. An electromagnet could be used instead of a permanent magnet, along with a suitable control mechanism.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A pop-up drain assembly for a sink or basin having a drain opening, comprising:

piping for providing a fluid flow pathway from the sink or basin through the drain opening and through the piping, wherein the piping has a longitudinal axis and an inside wall that defines the fluid flow pathway, and wherein the piping has a pivot rod port;

a stopper for retaining fluid in the sink or basin, wherein the stopper is received in the piping while in operation and is moveable between an open position and a closed position; and a pivot rod for moving the stopper between the open position and the closed position, wherein the pivot rod is attached to the piping at the pivot rod port, wherein the pivot rod is pivotable between upward and downward positions, and while in operation, wherein the pivot rod does not protrude significantly inside the piping and the stopper has a side portion located adjacent to the pivot rod port, wherein the side portion comprises a longitudinal side edge and a magnet or a magnetic material, wherein the pivot rod has a stopper end located within the pivot rod port, wherein the stopper end abuts the longitudinal side edge of the side portion of the stopper, and wherein the stopper end of the pivot rod is magnetically coupled to the stopper for moving the stopper.

2. The pop-up drain assembly of claim 1, wherein the stopper end of the pivot rod comprises a magnet or magnetic material, wherein at least one of the stopper and the pivot rod comprises a magnet, wherein the stopper has a bottom end that is a lowermost point of the stopper while in operation, and wherein the stopper end of the pivot rod is higher than the bottom end of the stopper.

3. The pop-up drain assembly of claim 1, wherein the inside wall of the piping at the pivot rod port defines a circular cylindrical space, wherein the stopper end of the pivot rod protrudes into the piping no more than about 10 mm, and wherein the stopper comprises a shaft and a cap on an upper end of the shaft for providing a seal to prevent fluid from flowing into the piping while in operation.

4. The pop-up drain assembly of claim 1, wherein the stopper comprises a shaft and a cap on an upper end of the shaft for providing a seal to prevent fluid from flowing into the piping while in operation, wherein the shaft has a longitudinal axis and the magnet or magnetic material of the stopper is radially offset from the longitudinal axis, and wherein the stopper end of the pivot rod is approximately flush with the inside wall of the piping while the stopper is in its closed position.

5. The pop-up drain assembly of claim 1, wherein the stopper end of the pivot rod comprises a magnet or magnetic material, wherein at least one of the stopper and the pivot rod comprises a magnet, and wherein the stopper does not rest on the stopper end of the pivot rod.

6. The pop-up drain assembly of claim 1, wherein the stopper comprises a hollow tube having an outer wall, and wherein a magnet (or magnetic material) is fixed to and/or embedded in the outer wall for magnetically coupling with the pivot rod.

7. The pop-up drain assembly of claim 6, wherein two or more magnets (or magnetic material) are fixed to and/or embedded in the outer wall for magnetically coupling with the pivot rod, and wherein the two or more magnets (or magnetic material) are spaced apart longitudinally.

8. The pop-up drain assembly of claim 1, further comprising a tubular stub surrounding the pivot rod port and projecting outwardly from the piping; and a pivot rod ball received in the tubular stub, wherein the pivot rod is moveably received in the pivot rod ball so that the distance between the stopper end of the pivot rod and the pivot rod ball can be adjusted, wherein the stopper end of the pivot rod is approximately flush with the inside wall of the piping while the stopper is in its closed position.

9. The pop-up drain assembly of claim 8, wherein the stopper comprises an elongated hollow tube having a cap on one end.

10. The pop-up drain assembly of claim 1, wherein the stopper comprises an elongate shaft having a longitudinal axis, a cap on an upper end while installed and an opposing lower end, wherein the side portion of the stopper comprises an extension plate having a longitudinal axis extends downwardly from the lower end, wherein the longitudinal axis of the extension plate is offset radially from and essentially parallel to the longitudinal axis of the shaft, and wherein the extension plate has one or more magnets or is comprised of a magnetic material.

11. The pop-up drain assembly of claim 10, further comprising a flow diverter fixed to the stopper for diverting flow away from the extension plate.

12. The pop-up drain assembly of claim 1, wherein the stopper end of the pivot rod is a magnet or a magnetic material, and wherein the stopper end of the pivot rod does not extend underneath the stopper within the piping.

13. The pop-up drain assembly of claim 12, wherein the stopper end of the pivot rod is moveable with respect to the rest of the pivot rod.

14. The pop-up drain assembly of claim 13, further comprising a spring or a resilient material for moving the stopper end of the pivot rod longitudinally outwardly with respect to the rest of the pivot rod.

15. The pop-up drain assembly of claim 1, further comprising a pivot ball mounted on the pivot rod, wherein the distance between an end of the pivot rod and the pivot ball can be adjusted while installing the pivot rod.

16. The pop-up drain assembly of claim 1, wherein the stopper comprises a hollow tube having an outer wall, the outer wall having an opening through which fluid in the sink or basin can pass while the stopper is in the open position, and wherein a magnet is fixed to and/or embedded in the outer wall or the outer wall comprises a magnetic material, further comprising a gasket or seal around the outer wall for sealingly engaging the piping while in operation.

17. The pop-up drain assembly of claim 1, wherein the stopper has a cap on one end and an opposing end, and wherein the distance between the cap and the opposing end is adjustable.

18. The pop-up drain assembly of claim 1, further comprising means for screening fluid that flows through the piping.

19. The pop-up drain assembly of claim 18, wherein the stopper incorporates the means for screening fluid.

20. A retrofit kit for a pop-up drain assembly, comprising:

a stopper comprising a body having at least three longitudinal fins that project radially and define an outermost circumference of the body, a cap on one end of the body for providing a seal and a magnet holder extending from one of the fins away from the cap end, wherein the magnet holder has an outer surface approximately and substantially aligned with the outermost circumference, and wherein a magnet or a magnetic material is received in the magnet holder;

a pivot rod having a stopper end, an outer end and external threads that extend from the stopper end toward the outer end, wherein the stopper end comprises a magnet or a magnetic material for forming a magnetic coupling with the magnet or magnetic material of the stopper; and a pivot ball having a bore extending through the pivot ball and internal threads that define the bore, wherein the ball has an entrance opening to the bore and an exit opening from the bore, wherein the internal threads in the pivot ball matingly engage the external threads on the pivot rod, wherein the stopper end of the pivot rod can be placed in the entrance opening of the bore, wherein the ball can be threaded onto the rod until the stopper end of the pivot rod passes through the exit opening and protrudes a desired distance outside the pivot ball, thereby providing an adjustable distance between the pivot ball on the pivot rod and the stopper end of the pivot rod.

21. The pop-up drain assembly of claim 1, wherein the pivot rod is an elongate cylinder having a length between about 6 to about 12 inches and a diameter ranging from about 0.125 to about 0.375 inches.

22. The pop-up drain assembly of claim 1, wherein the stopper end of the pivot rod comprises a magnet or a magnetic material wherein the stopper end of the pivot rod touches the longitudinal side edge of the side portion of the stopper, wherein the longitudinal side edge of the side portion is oriented vertically while in operation, and wherein the connection between the longitudinal side edge of the stopper and the pivot rod resembles the shape of the capital letter T rotated 90 degrees.

23. A pop-up drain assembly for a sink or basin having a drain opening, comprising:

a drain pipe for providing a fluid flow pathway from the sink or basin through the drain opening and through the drain pipe, wherein the drain pipe has a pivot rod port and a tubular stub surrounding the pivot rod port, wherein the tubular stub projects radially outwardly;

a stopper for retaining fluid in the sink or basin, wherein the stopper is received in the drain pipe while in operation and is moveable between an open position and a closed position, wherein the stopper has upper and lower ends, a longitudinal axis and a longitudinal side edge, wherein the lower end of the stopper comprises a magnet or a magnetic material, wherein the magnet or magnetic material of the stopper is offset radially from the longitudinal axis of the stopper so that the magnet or magnetic material of the stopper is located adjacent to the pivot rod port; and a pivot rod for moving the stopper between the open position and the closed position, wherein the pivot rod has a stopper end, wherein the stopper end of the pivot rod is received in the tubular stub, wherein the stopper end of the pivot rod comprises a magnet or a magnetic material, wherein the stopper end of the pivot rod is magnetically coupled to the magnet or magnetic material of the stopper, wherein the stopper end of the pivot rod abuts the longitudinal side edge of the stopper, and wherein the pivot rod does not extend underneath the stopper inside the drain pipe.

24. The pop-up drain assembly of claim 23, further comprising a pivot ball having a bore, wherein the pivot rod is received in the bore, and wherein the pivot ball is received in the tubular stub such that the stopper end of the pivot rod is received in the tubular stub.

25. The pop-up drain assembly of claim 24, wherein the distance between the pivot ball and the outermost tip of the stopper end of the pivot rod is adjustable.

26. The pop-up drain assembly of claim 23, wherein the magnet or magnetic material in the stopper has a length so that the stopper will operate with different drain pipes that have a different distance between an upper end and the tubular stub.

27. The pop-up drain assembly of claim 26, further comprising a pivot ball having a bore, wherein the pivot rod is received in the bore, wherein the pivot ball is received in the tubular stub such that the stopper end of the pivot rod is received in the tubular stub, and wherein the distance between the pivot ball and the stopper end of the pivot rod is adjustable.

28. The pop-up drain assembly of claim 23, wherein the stopper has at least two flanges that extend radially from the longitudinal axis for centering the stopper in the drain pipe, and wherein the magnet or magnetic material of the stopper depends from one of the flanges.

29. The pop-up drain assembly of claim 28, wherein the drain pipe has an inside surface that defines the fluid flow pathway, wherein the stopper has a holder depending from at least one of the flanges that is bonded to or formed integral with the stopper, wherein the magnet or magnetic material is received in the holder, wherein the magnet or magnetic material has a length extending downwardly along the inside surface of the drain pipe, and wherein the holder is positioned to locate the magnet or magnetic material adjacent to the pivot rod port.

30. The pop-up drain assembly of claim 29, wherein the magnet or magnetic material of the stopper has a top end, a bottom end and a longitudinal axis that is essentially parallel to the longitudinal axis of the stopper, and wherein the stopper end of the pivot rod is located adjacent to the magnet or magnetic material of the stopper between the top and bottom ends.

31. The pop-up drain assembly of claim 30, wherein the stopper end of the pivot rod is approximately flush with the inside surface of the drain pipe while the stopper is in its open or closed position, and wherein the outermost tip of the stopper end of the pivot rod protrudes no more than about 3 mm into the fluid flow pathway while moving the stopper between its closed and open positions.

32. The pop-up drain assembly of claim 23, wherein the stopper further comprises flow diverters, wherein the flow diverters consist essentially of first and second opposing plates having a length parallel to the longitudinal axis and a width transverse to the longitudinal axis of the stopper, wherein the length of the first and second plates is substantially greater than the width of the first and second plates, and wherein the magnet or magnetic material of the stopper is located between the first and second plates.

33. The pop-up drain assembly of claim 23, wherein the stopper further comprises means for screening.

34. A drain stopper for a sink or basin, comprising:

a central, longitudinal shaft having a longitudinal axis, an upper end and an opposing lower end;

a cap received on the upper end for providing a seal to retain fluid in the sink or basin;

a first plate having a length, a width and opposing upper and lower ends for diverting flow away from the lower end of the shaft, wherein the upper end of the first plate is fixed directly or indirectly to or formed integral with the shaft, and wherein the lower end of the plate is free; and a second plate fixed directly or indirectly to or formed integral with the shaft opposite of the first plate for diverting flow away from the lower end of the shaft, the second plate having a length, a width and opposing upper and lower ends, wherein the lower end of the plate is free, wherein the length of the first and second plates is substantially greater than the width, wherein each of the first and second plates has an interior planar surface facing toward the longitudinal axis and an opposing exterior planar surface facing away from the longitudinal axis, wherein the first and second plates extend downwardly toward, to or past the lower end of the shaft, wherein the upper end of each of the first and second plates is adjacent to the longitudinal axis, and wherein the lower end of each of the first and second plates is spaced outwardly from the longitudinal axis, further comprising a pivot rod holder located on the lower end of the shaft and between interior planar surfaces of the first and second plates, the pivot rod holder comprising two prongs that extend downwardly, wherein a slot is defined between the two prongs, and wherein the two prongs comprise an elastomeric and/or flexible material for receiving a pivot rod in a friction fit within the slot.

35. The drain stopper of claim 34, further comprising two or more longitudinal fins that have a length extending along the longitudinal axis and that project radially from the longitudinal axis for centralizing the drain stopper in a drain pipe.

* * * * *